US006480218B2

(12) United States Patent
Kurematsu

(10) Patent No.: US 6,480,218 B2
(45) Date of Patent: Nov. 12, 2002

(54) PRINTER FOR RECORDING AN IMAGE ON A RECORDING MATERIAL

(75) Inventor: Masayuki Kurematsu, Hino (JP)

(73) Assignee: Konica Corporation, Tokyo (JP)

( * ) Notice: Subject to any disclaimer, the term of this patent is extended or adjusted under 35 U.S.C. 154(b) by 0 days.

(21) Appl. No.: 09/726,051

(22) Filed: Nov. 30, 2000

(65) Prior Publication Data

US 2001/0004265 A1 Jun. 21, 2001

(30) Foreign Application Priority Data

Dec. 3, 1999 (JP) ..... 11-344108
Mar. 8, 2000 (JP) ..... 2000-063165

(51) Int. Cl.[7] ..... B41J 2/47
(52) U.S. Cl. ..... 347/239; 347/255
(58) Field of Search ..... 347/134, 239, 347/241, 255, 256; 345/85; 359/223, 224, 298; 348/770, 771; 385/16, 73, 77, 116, 120

(56) References Cited

U.S. PATENT DOCUMENTS 4,596,992 A * 6/1986 Hornbeck ..... 347/134
5,033,814 A * 7/1991 Brown et al. ..... 385/16
5,105,299 A * 4/1992 Anderson et al. ..... 359/223
5,517,347 A * 5/1996 Sampsell ..... 359/224
5,684,620 A * 11/1997 Schoon ..... 359/298
5,796,508 A * 8/1998 Suzuki ..... 359/224
6,049,317 A * 4/2000 Thompson et al. ..... 345/85

* cited by examiner

*Primary Examiner*—Hai Pham
(74) *Attorney, Agent, or Firm*—Finnegan, Henderson, Farabow, Garrett & Dunner, L.L.P.

(57) ABSTRACT

The present invention concerns a printer for recording an image on a recording material by using a reflecting device such as a digital micro-mirror device or a D-ILA device. The printer includes a light source to emit irradiation light; a reflecting device to reflect the irradiation light, the reflecting device being integrated with a plurality of micro-reflectors, which are arrayed in two-dimensional directions of rows and lines, and each of which is independently controllable to vary a reflection angle of the irradiation light emitted from the light source; a light splitter to split reflection light reflected by the reflecting device; a light guide to guide the reflection light, split by the light splitter, to a predetermined position on the recording material; and a conveying device to move the recording material in a predetermined direction.

4 Claims, 15 Drawing Sheets

FIG. 6
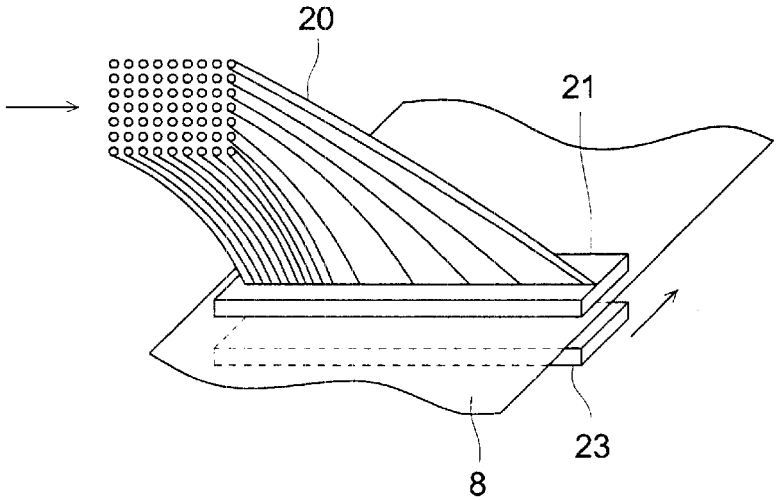
FIG. 7 ( a )
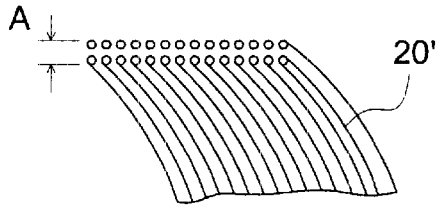
FIG. 7 ( b )
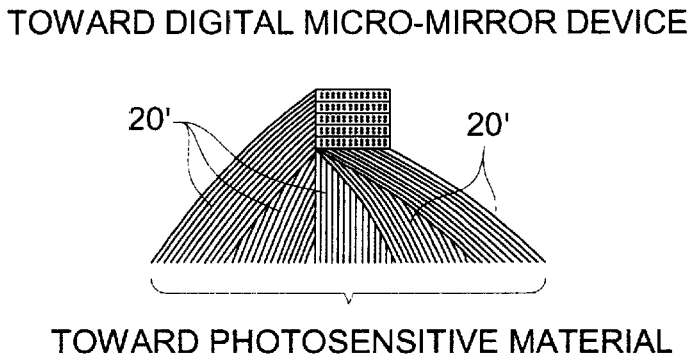

FIG. 14 (a)
FIG. 14 (b)
FIG. 14 (c)
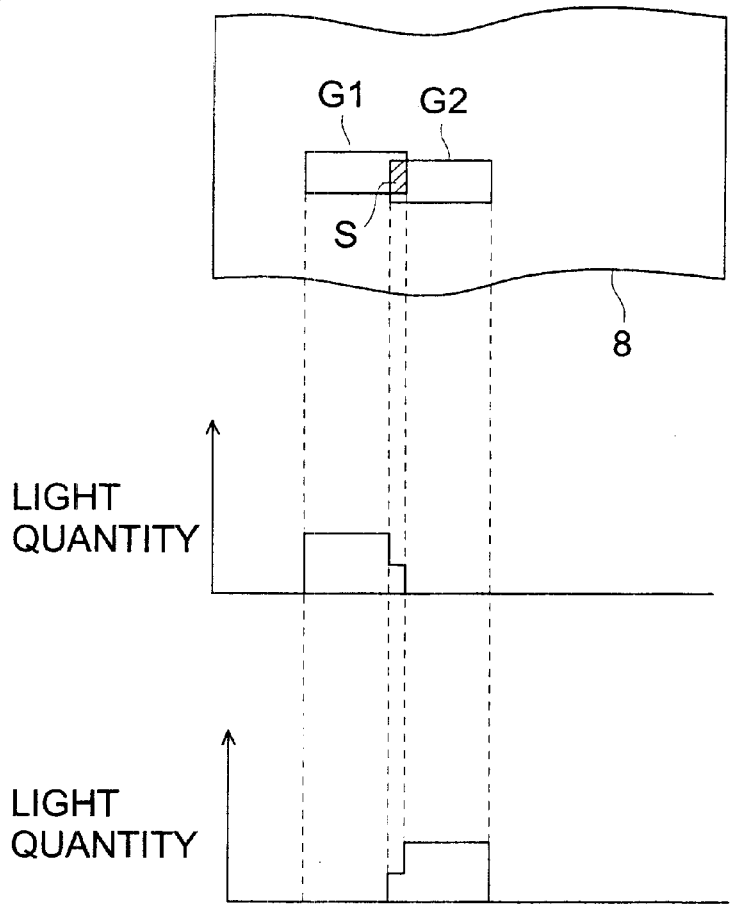
FIG. 15
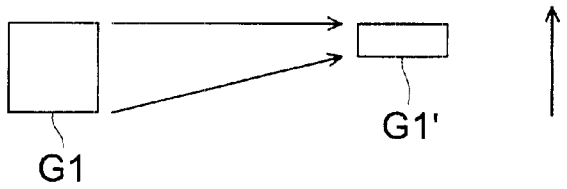

FIG. 22 ( a )
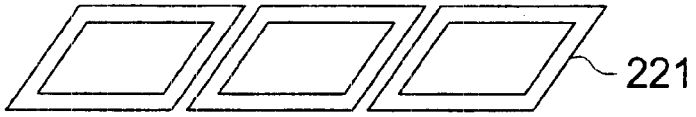
FIG. 22 ( b )
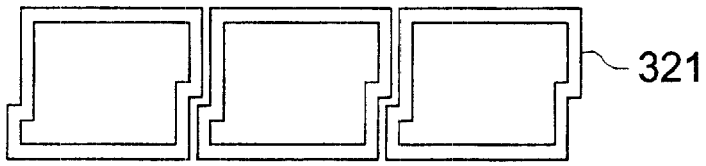

PRINTER FOR RECORDING AN IMAGE ON A RECORDING MATERIAL

BACKGROUND OF THE INVENTION

This invention relates to a printer for a recording material, and in particular, to a printer for a recording material in which an image is formed by using a reflecting means such as a digital micro-mirror device or a D-ILA device.

In recent years, image processing technology based on a personal computer etc. has made a progress, for example, in plate-making or photoengraving, without forming a film for plate-making, directly forming a plate for printing has been in practice. In order to form a printing plate directly in this way, exposure technology using a digital imaging light is remarked.

Such a digital imaging light is controlled for each pixel by a digital micro-mirror device (reflecting means) having a number of small pieces of micro-mirrors (micro-reflectors), each of which is capable of varying the reflection angle of a bundle of rays, arrayed in the directions of rows and lines. Such a digital micro-mirror device is now put on the market, for example, with a trade name called DLP from Texas Instruments Inc. in USA, and also a digital projector using this device is put on the market. On the other hand, a D-ILA device having a similar function is also known as a reflecting means.

Further, it has been heretofore known to use such a digital micro-mirror device in the exposure of a recording material (for example, by the publications of unexamined patent application H10-104953 and H9-164727), and a printer for a recording material using this has been provided to the market.

Incidentally, for an image forming apparatus in which an image is formed by applying a digital imaging light to a recording material, a laser exposure apparatus using a laser beam, etc. can be cited, but these have the defect that they are comparably high-priced and weak against vibration. On the contrary, an image forming apparatus which carries out the formation of an image using a digital micro-mirror device has an advantage that it has stability in exposure, ease of operation, a reasonable cost of the apparatus. However, there is a problem that it is inferior in image quality. The reason will be explained in the following.

In the digital micro-mirror device, one micro-mirror has a small size of 16 $\mu$m×16 $\mu$m, but the number of pixels included in a digital micro-mirror device which is generally put on the market is 600×800 pixels, 1280×1024 pixels, or 208×1152 pixels; this is sufficient for use in a projector or the like, but it is not suitable for forming a high-quality image on a recording material.

For example, assuming that the whole surface of a recording material having a width of 250 mm is exposed by using a digital micro-mirror device having the largest number of pixels in a line (2048 pixels), the number of pixels (number of dots) per 2.54 cm (1 inch) becomes 205 (205 dpi).

This number of dots is sufficient for use in a digital projector or a high definition TV, but it is not sufficient for a recording material which requires 600 to 3000 as the number of pixel data per 2.54 cm (per 1 inch) in some uses. For this reason, in a conventional printer for a recording material, by limiting the enlargement magnification from the digital micro-mirror device, that is, by limiting the width of the recording material to be exposed (namely, the maximum image width), image quality is kept at or over a certain value. Against this, it would be very convenient if an image could be formed on a recording material having a broader width by using this method.

In order to form an image on a recording material having a broader width without lowering image quality, it can be thought of to increase the number of micro-mirrors in one side of a single digital micro-mirror device to a large degree. However, it is not desirable to particularly manufacture such a digital micro-mirror device because it brings about the increase of cost.

SUMMARY OF THE INVENTION

It is an object of this invention, by using a reflecting means such as a digital micro-mirror device or a D-ILA device, to provide a printer for a recording material capable of forming an image on a recording material having a broader width with the image quality kept at a certain level.

Further, in the case where exposure is done using a digital imaging light, it is necessary to make a suitable exposure control for the conveying of a recording material; there is a problem, for example, how the fluctuation of conveyance speed etc. should be corrected.

It is another object of this invention, by using a digital imaging light, to provide a digital printer for a recording material capable of forming a high-quality image at a lower cost.

Accordingly, to overcome the cited shortcomings, the abovementioned objects of the present invention can be attained by a printer, a light splitting device and a method described as follow.

(1) A printer for recording an image on a recording material, comprising: a light source to emit irradiation light; a reflecting device to reflect the irradiation light, the reflecting device being integrated with a plurality of micro-reflectors, which are arrayed in two-dimensional directions of rows and lines, and each of which is independently controllable to vary a reflection angle of the irradiation light emitted from the light source; a light splitter to split reflection light reflected by the reflecting device; a light guide to guide the reflection light, split by the light splitter, to a predetermined position on the recording material; and a conveying device to move the recording material in a predetermined direction.

(2) A light splitting device used for recording a digital image on a recording material, comprising: a light developing element to split an irradiation light, having a two-dimensional surface comprising directions of rows and lines for receiving the irradiation light, and to form the irradiation light in a line.

(3) A method for recording a digital image onto a recording material, comprising the steps of: emitting irradiation light from a light source; reflecting the irradiation light by reflecting device integrated with a plurality of micro-reflectors, arrayed in two-dimensional directions of rows and lines, each of which is independently controllable to vary a reflection angle of the irradiation light emitted from the light source; splitting reflection light reflected by the reflecting device; guiding the reflection light, split in the splitting step, to a predetermined position on the recording material; and moving the recording material in a predetermined direction with respect to the reflection light, guided in the guiding step.

Further, to overcome the abovementioned problems, other printers and methods, embodied in the present invention, will be described as follow.

The first printer for a recording material of this invention is a printer for a recording material for making the recording material exposed to a digital image, and is characterized by it that said printer comprises a light source for emitting an irradiation light, reflecting means having a plurality of micro-reflectors, integrated two-dimensionally in the row direction and in the line direction in a manner such that the reflection angle of each of them can be independently controlled, for reflecting the irradiation light from said light source at the surface of said micro-reflectors, splitting means for splitting the reflected light from said reflecting means into a plurality of parts, means for conducting the plural parts of the reflected light obtained by said splitting means to specified positions respectively on the recording material, and moving means for moving said recording material to a specified direction.

The second printer for a recording material of this invention is a printer for a recording material for making the recording material exposed to a digital image, and is characterized by it, that said printer comprises a light source for emitting an irradiation light, reflecting means having a plurality of micro-reflectors, integrated two-dimensionally in the row direction and in the line direction in a manner such that the reflection angle of each of them can be independently controlled, for reflecting the irradiation light from said light source at the surface of said micro-reflectors, a plurality of optical fibers having one end facing said reflecting means and the other end facing said recording material, and moving means for moving said recording material to a specified direction, wherein one end of each optical fiber is disposed at a specified position corresponding to said reflecting means.

The third printer for a recording material of this invention is a printer for a recording material for making the recording material exposed to a digital image, and is characterized by it, that said printer comprises a laser light source for emitting a laser beam, reflecting means having a plurality of micro-reflectors, integrated two-dimensionally in the row direction and in the line direction in a manner such that the reflection angle of each of them can be independently controlled, for reflecting the irradiation laser beam from said laser light source at the surface of said micro-reflectors, splitting means for splitting the reflected light from said reflecting means into a plurality of parts, means for conducting the plural parts of the reflected light obtained by said splitting means to specified positions respectively on the recording material, and moving means for moving said recording material to a specified direction.

The fourth printer for a recording material of this invention is a printer for a recording material for making the recording material exposed to a digital image, and is characterized by it, that said printer comprises a laser light source for emitting a laser beam, reflecting means having a plurality of micro-reflectors, integrated two-dimensionally in the row direction and in the line direction in a manner such that the reflection angle of each of them can be independently controlled, for reflecting the irradiating laser beam from said laser light source at the surface of said micro-reflectors, a plurality of optical fibers having one end facing said reflecting means and the other end facing said recording material, and moving means for moving said recording material to a specified direction, wherein one end of each optical fiber is disposed at a specified position corresponding to said reflecting means.

The fifth printer for a recording material of this invention is a printer for a recording material for making the recording material exposed to a digital image, and is characterized by it that said printer comprises a light source for emitting an irradiation light, splitting means for splitting the irradiation light from said light source into a plurality of parts, a plurality of reflecting means having a plurality of micro-reflectors, integrated two-dimensionally in the row direction and in the line direction in a manner such that the reflection angle of each of them can be independently controlled, for reflecting respectively the plural parts of the irradiation light obtained by said splitting means at the surface of said micro-reflectors, a plurality of lenses for receiving the reflected light beams from the plural micro-reflectors of said reflecting means and conducting said beams respectively to specified positions on the recording material, and moving means for moving said recording material to a specified direction.

The sixth printer for a recording material of this invention is a printer for a recording material for making the recording material exposed to a digital image, and is characterized by it that said printer comprises a light source for emitting an irradiation light, reflecting means having a plurality of micro-reflectors, integrated two-dimensionally in the row direction and in the line direction in a manner such that the reflection angle of each of them can be independently controlled, for reflecting the irradiation light from said light source at the surface of said micro-reflectors, splitting means for splitting the reflected light from said reflecting means into a plurality of parts, means for conducting the plural parts of the reflected light obtained by said splitting means respectively to specified positions on the recording material, and moving means for moving said recording material to a specified direction, wherein with respect to said plural parts of the reflected light, a portion of any one of said plurality of parts of the reflected light is made to overlap a portion of another neighboring one on said recording material, and in the case where the image to be formed has a uniform gradation, in any one of the parts of the reflected light, the light quantity of said overlapping portion is made lower than the light quantity of the remaining portion which does not overlap another.

The seventh printer for a recording material of this invention is a printer for a recording material for making the recording material exposed to a digital image, and is characterized by it that said printer comprises a light source for emitting an irradiation light, reflecting means having a plurality of micro-reflectors, integrated two-dimensionally in the row direction and in the line direction in a manner such that the reflection angle of each of them can be independently controlled, for reflecting the irradiation light from said light source at the surface of said micro-reflectors, splitting means for splitting the reflected light from said reflecting means into a plurality of parts, means for conducting the plural parts of the reflected light having a rectangular shape obtained by said splitting means respectively to specified positions on the recording material, and moving means for moving said recording material to a specified direction, wherein said plural parts of the reflected light include an image which is compressed in the moving direction of said recording material, and an image is formed on said recording material by said moving means moving said recording material at a speed corresponding to the operation cycle of said micro-reflectors.

The eighth printer for a recording material of this invention is a printer for a recording material for making the recording material exposed to a digital image, and is characterized by it, that said printer comprises a light source for emitting an irradiation light, reflecting means having a plurality of micro-reflectors, integrated two-dimensionally in the row direction and in the line direction in a manner such that the reflection angle of each of them can be independently controlled, for reflecting the irradiation light from said light source at the surface of said micro-reflectors to form a digital imaging light, splitting means for splitting the digital imaging light from said reflecting means into a plurality of parts, means for conducting the plural parts of the digital imaging light obtained by said splitting means respectively to specified positions on the recording material, and moving means for moving said recording material to a specified direction, wherein an objective optical system is disposed between said splitting means and said recording material, and said objective optical system forms an image of said digital imaging light on the surface of said recording material.

The ninth printer for a recording material of this invention is a printer for a recording material for making the recording material exposed to a digital image, and is characterized by it that said printer comprises a light source for emitting a white light, a color filter for transmitting the white light emitted from said light source, reflecting means having a plurality of micro-reflectors, integrated two-dimensionally in the row direction and in the line direction in a manner such that the reflection angle of each of them can be independently controlled, for reflecting the irradiation light transmitted through said color filter at the surface of said micro-reflectors, splitting means for splitting the reflected light from said reflecting means into a plurality of parts, means for conducting the plural parts of the reflected light obtained by said splitting means respectively to specified positions on the recording material, and moving means for moving said recording material to a specified direction, wherein said filter includes portions transmitting blue, green, red, and achromatic light respectively, and is made to change over the portion for transmitting said white light in accordance with the image to be formed.

The first printer for a recording material of this invention is a printer for a recording material for making the recording material exposed to a digital image, and it comprises a light source for emitting an irradiation light, reflecting means having a plurality of micro-reflectors, integrated two-dimensionally in the row direction and in the line direction in a manner such that the reflection angle of each of them can be independently controlled, for reflecting the irradiation light from said light source at the surface of said micro-reflectors, splitting means for splitting the reflected light from said reflecting means into a plurality of parts, means for conducting the plural parts of the reflected light obtained by said splitting means respectively to specified positions on the recording material, and moving means for moving said recording material to a specified direction; therefore, it can make an exposure with an image of one frame split in the width direction (for example, in the direction perpendicular to the moving direction of the recording material), and owing to it, it is possible to form a high-quality image by increasing the number of dots per 2.54 cm (1 inch), even in the case where said reflecting means has a comparatively small number of micro-reflectors.

In addition, the term reflecting means used in this specification means, for example, the one that is put on the market by a trade name called DLP from the Texas Instruments Inc. in USA, and is capable of electronically controlling the reflection angle of each of the micro-reflectors independently, but it is not limited to this.

Moreover, it is desirable that the aforesaid splitting means is a mirror or a prism, because these can make up a splitting means with a high precision.

Further, if the aforesaid reflected light is split at intervals of specified number of pixels in the directions of rows and lines of said micro-reflectors, to form a plurality of rectangular-shaped parts of a digital imaging light, and an image is formed by combining said plural parts of digital imaging light to irradiate the aforesaid recording material, for example, by forming a plurality of parts of the digital imaging light having a rectangular shape with short shorter sides and joining them in the longer side direction, an image having a broad width can be formed.

Further, if the aforesaid plural parts of the digital imaging light irradiate the recording material, being arrayed in the direction perpendicular to the moving direction of the recording material, by making exposure repeatedly to a digital imaging light one after another in synchronism with the moving of said recording material, a large image can be formed.

Further, when an exposure is made with the aforesaid recording material being moved, if the end portions of neighboring pixels of the aforesaid plural parts of the digital imaging light irradiate the same area of said recording material doubly, the digital imaging light has no discontinuity at the joining portions, and a high-quality image can be formed.

Further, it is desirable that the aforesaid digital imaging light is split into a plurality of approximately square-shaped parts, which are arrayed approximately in a line, to irradiate a line-shaped area on the recording material along the first direction, and the recording material is moved in the second direction perpendicular to said first direction. If a digital imaging light having a shape of a square of equal sides is formed, in the case where a lens is disposed between the splitting means and the recording material, it is possible to make small the diameter of this lens, and owing to it, it is possible that the structure of the printer is made small-sized and the cost of the printer is made of low cost.

Further, if the end portions of a pair of the aforesaid parts of the digital imaging light adjacent to each other in the aforesaid first direction and the end portions of another pair of the aforesaid parts of it adjacent to each other in the aforesaid second direction doubly irradiate the same areas of the recording material respectively, the digital imaging light has no discontinuity at the joining portions, and a high-quality image can be formed.

Further, if an optical system is disposed between the aforesaid reflecting means and the aforesaid splitting means, and said optical system forms an image of the aforesaid digital imaging light on said splitting means or on a surface in the neighborhood of it, even in the case, for example, where the cross-sectional area of the [bundle of rays reflected by the micro-reflectors] reflected digital imaging light is large, the cross-sectional area of such a reflected light as this can be adjusted by said optical system in accordance with the size and shape of said splitting means, and an image having a higher image quality can be formed.

Further, if an objective optical system is disposed between the aforesaid splitting means and the aforesaid recording material, and said objective optical system forms an image of the aforesaid digital imaging light on the surface of said recording material, even in the case, for example, where the cross-sectional area of the bundle of rays of the digital imaging light from the splitting means is large, the cross-sectional area of such a reflected light as this can be adjusted by said objective optical system in accordance with the size of said recording material, and an image having a higher image quality can be formed.

In addition, the border of any two neighboring mirror surfaces of a mirror having a plurality of mirror surfaces as an example of the splitting means is not stable in its reflection condition; therefore, it is desirable to take some countermeasure such as making the portion black so as not to reflect light, or not using the portion of the reflecting means corresponding to that portion (portion forming the image on the border).

The second printer for a recording material of this invention is a printer for a recording material for making the recording material exposed to a digital image, and it comprises a light source for emitting an irradiation light, reflecting means having a plurality of micro-reflectors, integrated two-dimensionally in the row direction and in the line direction in a manner such that the reflection angle of each of them can be independently controlled, for reflecting the irradiation light from said light source at the surface of said micro-reflectors, a plurality of optical fibers having one end facing said reflecting means and the other end facing said recording material, and moving means for moving said recording material to a specified direction, and one end of each optical fiber is disposed at a specified position corresponding to said reflecting means; therefore, by transmitting the reflected bundles of rays reflected by the respective micro-reflectors by using optical fibers, the reflected bundles of rays can be conducted to the specified positions on the recording material without enlarging the cross-sectional area (the size of pixel) of the reflected bundles of rays. For example, by making the other end of the bundle of the optical fibers have the shape of a thin rectangle with broadened sides, the longer sides can be enlarged in accordance with the shortening of the shorter sides, which makes it possible to form an image having a broad width. In this case, the number of pixels along the direction of the shorter sides in a single exposure becomes small, but by moving the recording material in the direction along the shorter sides, a large image can be formed.

Further, if the other ends of the aforesaid optical fibers are arrayed in a line in the direction perpendicular to the moving direction of the aforesaid recording material, an image having a broader width can be formed.

Further, if the aforesaid printer has a structure such that the aforesaid reflected light to be transmitted through the aforesaid optical fibers have been split at intervals of a specified number of pixels in the row direction or in the line direction of the array of the aforesaid micro-reflectors, to form a plurality of rectangular-shaped parts of the digital imaging light, and an image is formed by irradiating the aforesaid recording material by said digital imaging light, an image having an arbitrary size can be formed.

Further, if an optical system is disposed between the aforesaid reflecting means and the aforesaid optical fibers, and said optical system forms the image of the light reflected by said reflecting means on the one surface of said optical fibers or on a surface in the neighborhood of it, by making the reflected light form an image (focusing) on the one end of the optical fibers through said optical system (for example, a lens), an image having a higher image quality can be obtained.

For example, for a micro-reflector of the reflecting means having the size of 16 $\mu$m square, by forming its image on the one end surface of the optical fiber with the size reduced to 4 $\mu$m square, and using an optical fiber having the diameter of 2 $\mu$m, an exposure of higher definition than that corresponding to the pixel size which the reflecting means it self comprises can be done. Moreover, by making the size 4 $\mu$m square, a high-definition image of the level of 5000 dpi can be actualized even if deterioration of pixels occurs on the way of transmission of the digital imaging light.

In addition, it has been known that for a silver halide color paper, 600 dpi (600 pixels per 2.54 cm (1 inch)) is equivalent to the number of pixels per unit length which the color paper itself comprises, and even though the dot size is made finer, so much higher image quality can not be expected. In this connection, 600 dpi means the pixel of about 41 $\mu$m square or circle. In this case, assuming that, for example, the diameter of the optical fiber is 10 $\mu$m and the micro-reflector is 15 $\mu$m square, by forming the image on the one end surface of the optical fiber with the size enlarged to 30 $\mu$m square by a lens, the recording with 600 dpi can be carried out.

Further, if an objective optical system is disposed between the aforesaid optical fibers and the aforesaid recording material, said objective optical system conducting the light emerging from the other end of said optical fibers to the recording material, the scattering of light can be prevented at the time of irradiating the recording material. For such an objective optical system, for example, a SELFOC lens (array or plate) which is put on the market by Nippon Sheet Glass Co., Ltd. can be used, but it is not limited to this.

Further, it is desirable if the aforesaid optical fibers are formed as a bundle with a rectangular-shaped cross-section having the longer sides corresponding to the width of the aforesaid reflecting means and the shorter sides approximately perpendicular to them, and a plurality of said bundles are arranged. For example, if the optical fibers are arranged at random, the relation of correspondence between the pixels of the reflecting means and the image formed on the recording material can not be obtained, and the conversion of the digital data becomes troublesome. Against this, by doing in the above-described way, the other end side of the optical fibers can be divided into a plurality of blocks, and by confirming the relation at the time of operation, the conversion of the digital data can be easily made.

Further, it is desirable that, at the one end side of the aforesaid optical fibers, the bundle with layers stacked in the direction of the shorter sides is arranged corresponding to the array of the micro-reflectors of the aforesaid reflecting means, and at the other end side of said optical fibers, said bundle is arranged in an array of a single line in the direction of the longer sides.

Further, it is desirable that the shorter sides of the bundles formed at the other end side of the aforesaid optical fibers are arranged in such a manner as to agree with the moving direction of the aforesaid recording material, and further, the shorter sides of said bundles which are adjacent to each other are brought into contact or overlapped each other, because this can prevent the discontinuity of the image.

Further, by making each of the aforesaid plural bundles include a specified number (for example, a comparatively small number from 100 to 10,000) of optical fibers which are the same for each of them, to form a partial bundle in this way, it is possible that the handling of them is simplified and the adjustment of the position for exposure is made easy. Further, manufacturing of the apparatus can be made easy, and the conversion of data can be simplified. In this case, an image guide which is put on the market by Sumita Optical Glass, Inc., Sumitomo Electric Industries, Ltd., etc. can be used. The image guide is a bundle made up of several thousands-several tens of thousands of optical fibers having a diameter of 2–14 $\mu$m to form a circular cross-section, and by using this, the reflected light from the reflecting means can be transmitted. In addition, such an image guide can be made to have a rectangular cross-section, and moreover, the adjustment of its shape can be done arbitrarily, for example, in a manner such that the one end side is made square-shaped and the other end side is made to have a shape of a long and narrow rectangle.

Further, if the mixing of the aforesaid reflected bundles of rays between the neighboring two or more bundles of optical fibers is prevented, by providing a light reflecting, absorbing, or intercepting layer on the outer periphery at the end portion of each bundle of optical fibers, the lowering of image quality owing to the mixing of bundles of rays can be prevented.

Further, if the mixing of the aforesaid reflected bundles of rays between the neighboring two or more optical fibers is prevented, by providing a light reflecting, absorbing, or intercepting layer on the outer periphery at the end portion of each optical fiber, the lowering of image quality owing to the mixing of lights can be prevented.

Further, it is desirable that a detecting means for detecting the light emerging from the other end of the aforesaid optical fibers, and by controlling the aforesaid micro-reflectors in accordance with the detection result by said detecting means, the recording material is exposed to the predetermined image. For example, in the case where light is transmitted by using a bundle of optical fibers, the relation between each of the micro-reflectors and the exposure position of the recording material is obtained by said detecting means, and by carrying out the conversion of the digital data on the basis of the result of this detecting, the desired image can be formed. Accordingly, the adjustment of the deviation of the position of the image can be made easily. In addition, for this detection, it can be thought of a mode of practice in which the adjustment is carried out using a detecting fixture, or a mode of practice in which a sensor is built in the printer for a recording material and, for example, at the time of turning-on of the electric power source, an automatic correction is made periodically.

Further, if the diameter of an optical fiber is made plural times of the pixel size based on the aforesaid micro-reflectors in order to make a plurality of lights from said micro-reflectors enter in a single optical fiber, and in the case where the reflected lights from a specified micro-reflector enters into a plurality of optical fibers, a control is carried out so as not to irradiate the recording material by the reflected light from said specified micro-reflector, by making said specified micro-reflector not to be used, the lowering of image quality can be prevented by making such a micro-reflector not to be used, in the case, for example, where a reflected light from the same micro-reflector enters into a plurality of optical fibers. Further, by making the digital imaging light composed of pixels of 20 $\mu$m square, and transmitting it through a number of thin optical fibers, the lowering of image quality can be prevented.

The third printer for a recording material of this invention is a printer for a recording material for making the recording material exposed to a digital image, and it comprises a laser light source for emitting a laser beam, reflecting means having a plurality of micro-reflectors, integrated two-dimensionally in the row direction and in the line direction in a manner such that the reflection angle of each of them can be independently controlled, for reflecting the irradiating laser beam from said laser light source at the surface of said micro-reflectors, splitting means for splitting the reflected light from said reflecting means into a plurality of parts, means for conducting the plural parts of the reflected light obtained by said splitting means respectively to specified positions on the recording material, and moving means for moving said recording material to a specified direction; therefore, an image can be formed by using a laser beam which is a stable parallel light, and a lens etc. are unnecessary, which makes the structure simpler. In the case of usual laser exposure, because the laser beam is applied by rotating a polygonal mirror at a high speed, there is a problem that non-uniform exposure is easy to occur by vibration; however, according to this invention, no movable portion except the reflecting means exists; therefore, a structure withstanding vibration can be provided.

The fourth printer for a recording material of this invention is a printer for a recording material for making the recording material exposed to a digital image, and said printer comprises a laser light source for emitting a laser beam, reflecting means having a plurality of micro-reflectors, integrated two-dimensionally in the row direction and in the line direction in a manner such that the reflection angle of each of them can be independently controlled, for reflecting the irradiating laser beam from said laser light source at the surface of said micro-reflectors, a plurality of optical fibers having one end facing said reflecting means and the other end facing said recording material, and moving means for moving said recording material to a specified direction, and one end of each optical fiber is disposed at a specified position corresponding to said reflecting means; therefore, an image can be formed by using a laser beam which is a stable parallel light, and a lens etc. are unnecessary, which makes the structure simpler. In the case of usual laser exposure, because the laser beam is applied by rotating a polygonal mirror at a high speed, there is a problem that non-uniform exposure is easy to occur by vibration; however, according to this invention, no movable portion except the reflecting means exists; therefore, a structure withstanding vibration can be provided.

Further, it is desirable that the aforesaid reflected light is split at intervals of a specified number of pixels in the direction of rows or in the direction of lines of said micro-reflectors, to form a plurality of rectangular-shaped parts of the digital imaging light, and an image is formed by combining said plural parts of the digital imaging light to irradiate the aforesaid recording material.

Further, if the digital imaging lights reflected by the aforesaid reflecting means are reduced by a lens, before irradiating the aforesaid recording material, an image having an arbitrary size can be formed.

Further, by inserting a lens between the aforesaid reflecting means and the aforesaid recording material and forming an image of the digital imaging light reflected by said reflecting means on said recording material for exposure, an image having a higher image quality can be formed.

Further, in the case where the cross-sectional area of the aforesaid irradiation laser beam is smaller than the surface area of the aforesaid micro-reflectors integrated two-dimensionally, by providing a lens between the light source of said irradiation laser beam and the aforesaid reflecting means, and applying said enlarged irradiation laser beam to said reflecting means, the cross-sectional area of the laser beam can be made to correspond to the size of the micro-reflectors integrated two-dimensionally, which makes it possible to form an image having a higher image quality.

The fifth printer for a recording material of this invention is a printer for a recording material for making the recording material exposed to a digital image, and said printer comprises a light source for emitting an irradiation light, splitting means for splitting the irradiation light from said light source into a plurality of parts, a plurality of reflecting means having a plurality of micro-reflectors, integrated two-dimensionally in the row direction and in the line direction in a manner such that the reflection angle of each of them can be independently controlled, for reflecting the plural parts of the irradiation light obtained by said splitting means at the surface of said micro-reflectors, a plurality of lenses for receiving the plural parts of the irradiation light reflected by the micro-reflectors of said plural reflecting means and conducting them respectively to specified positions on the recording material, and moving means for moving said recording material to a specified direction; therefore, it is possible to conduct the light from a single light source to the recording material through a plurality of paths including a plurality of reflecting means, and the moving speed of the recording material can be made higher; therefore, an image having a higher image quality can be formed at a high speed.

Further, it is desirable that the aforesaid plural parts of the irradiation light reflected by the plural reflecting means is arrayed in the direction perpendicular to the moving direction of the aforesaid recording material for irradiating it.

The sixth printer for a recording material of this invention is a printer for a recording material for making the recording material exposed to a digital image, and said printer comprises a light source for emitting an irradiation light, reflecting means having a plurality of micro-reflectors, integrated two-dimensionally in the row direction and in the line direction in a manner such that the reflection angle of each of them can be independently controlled, for reflecting the irradiation light from said light source at the surface of said micro-reflectors, splitting means for splitting the reflected light from said reflecting means into a plurality of parts, means for conducting the plural parts of the reflected light obtained by said splitting means respectively to specified positions on the recording material, and moving means for moving said recording material to a specified direction, and with respect to said plural parts of the reflected light, a portion of any one of said plurality of parts of the reflected light is made to overlap a portion of another neighboring one on said recording material, and in the case where the image to be formed has a uniform gradation, in any one of the parts of the reflected light, the light quantity of said overlapping portion is made lower than the light quantity of the remaining portion which does not overlap another; therefore, it can be prevented that the amount of exposure becomes excessively large at the portion where said parts of the reflected light overlap each other, which makes it possible to form an image having a higher image quality.

Further, in the case where the image to be formed has a uniform gradation, it is desirable that the sum of the light quantity obtained by it, that a portion of any one of the aforesaid plural parts of the reflected light overlaps a portion of another neighboring one, is approximately equal to the light quantity of the remaining non-overlapping portion, because an image having a high image quality can be formed.

The seventh printer for a recording material of this invention is a printer for a recording material for making the recording material exposed to a digital image, and said printer comprises a light source for emitting an irradiation light, reflecting means having a plurality of micro-reflectors, integrated in two-dimensionally in the row direction and in the line direction in a manner such that the reflection angle of each of them can be independently controlled, for reflecting the irradiation light from said light source at the surface of said micro-reflectors, splitting means for splitting the reflected light from said reflecting means into a plurality of parts, means for conducting the plural parts of the reflected light having a rectangular shape obtained by said splitting means respectively to specified positions on the recording material, and moving means for moving said recording material to a specified direction, and said plural parts of the reflected light include an image which is compressed in the moving direction of said recording material, and an image is formed on said recording material by said moving means moving said recording material at a speed corresponding to the operation cycle of said micro-reflectors; therefore, for example, by feeding a dot image compressed in the moving direction of the recording material, an image having a normal size can be formed in accordance with the moving of the recording material.

In addition, it is desirable that the aforesaid reflected light is compressed in a manner such that the shorter side comes to ⅓ or under of the longer side.

Further, it is desirable that the aforesaid reflected light is split at intervals of a specified number of pixels in the direction of rows or in the direction of lines of said micro-reflectors, to form a plurality of rectangular-shaped parts of the digital imaging light, and an image is formed by combining said plural parts of the digital imaging light to irradiate the aforesaid recording material.

Further, it is desirable that the printer has a structure such that the digital imaging light reflected by the aforesaid reflecting means irradiates the line-shaped portion of the recording material.

The eighth printer for a recording material of this invention is a printer for a recording material for making the recording material exposed to a digital image, and said printer comprises a light source for emitting an irradiation light, reflecting means having a plurality of micro-reflectors, integrated two-dimensionally in the row direction and in the line direction in a manner such that the reflection angle of each of them can be independently controlled, for reflecting the irradiation light from said light source at the surface of said micro-reflectors to form a digital imaging light, splitting means for splitting the digital imaging light from said reflecting means into a plurality of parts, means for conducting the plural parts of the digital imaging light obtained by said splitting means respectively to specified positions on the recording material, and moving means for moving said recording material to a specified direction, and an objective optical system is disposed between said splitting means and said recording material, and said objective optical system forms an image of said digital imaging light on the surface of said recording material; therefore, an image of higher definition can be formed stably in comparison with the conventional technology in which digital imaging light is enlarged to irradiate the recording material.

Further, it is desirable that the printer has a structure such that the digital imaging light reflected by the aforesaid reflecting means irradiates the line-shaped portion of the recording material.

The ninth printer for a recording material of this invention is a printer for a recording material for making the recording material exposed to a digital image, and said printer comprises a light source for emitting a white light, a color filter for transmitting the white light emitted from said light source, reflecting means having a plurality of micro-reflectors, integrated two-dimensionally in the row direction and in the line direction in a manner such that the reflection angle of each of them can be independently controlled, for reflecting the irradiation light transmitted through said color at the surface of said micro-reflectors, splitting means for splitting the reflected light from said reflecting means into a plurality of parts, means for conducting the plural parts of the reflected light obtained by said splitting means respectively to specified positions on the recording material, and moving means for moving said recording material to a specified direction, and said filter includes portions transmitting blue, green, red, and achromatic light respectively, and is made to change over the portion for transmitting said white light in accordance with the image to be formed; therefore, for example, in comparison with the case where a filter having portions transmitting three colors respectively is used, by providing a portion transmitting an achromatic light, the density in the black area of the recording material is raised, and an image with little spreading of colors can be formed, even if the recording material is moved at a high speed.

Further, it is desirable that the aforesaid color filter has a shape of circular plate capable of rotating freely, the areas obtained by dividing the plate into four forms the portions transmitting blue, green, red, and achromatic light respectively, and a drive means for rotating said color filter in accordance with the image to be formed.

The tenth printer for a recording material of this invention is a digital printer for a recording material for making the recording material exposed to a digital image, and is characterized by it, that said printer comprises a light source, means for generating two-dimensional digital imaging light, and light transfer means for conducting said two-dimensional digital imaging light to the recording material, and irradiating the recording material by said digital imaging light for exposure, said light transfer means is subjected to the re-arrangement or the movement of position in order that the number of pixels of said two-dimensional digital imaging light may be increased in one direction, and said recording material is moved relatively in the direction perpendicular to the direction of the increasing of the number of pixels.

The eleventh printer for a recording material of this invention is a digital printer for a recording material for making the recording material exposed to a digital image, and is characterized by it, that said printer comprises conveying means for conveying a recording material at an approximately constant speed, and digital exposure means for making an exposure to a digital imaging light on a line-shaped portion in the direction approximately perpendicular to the conveying direction of said recording material, said printer has a structure such that a circular plate member capable of rotating in connection with the operation of said conveying means is provided, and the moving speed of the outer circumference of said circular plate member is two or more times of the conveyance speed, movement detecting means for detecting the amount of movement of said circular plate member moving at said speed of two or more times of the conveyance speed or of a member moving in contact with said circular plate member is provided, and the result of detection by said movement detecting means is used in controlling said digital exposure means.

The twelfth printer for a recording material of this invention is a digital printer for a recording material for making the recording material exposed to a digital image, and is characterized by it, that said printer comprises a light source, means for generating two-dimensional digital imaging light, by reflecting the light from said light source independently by each of the plural micro-reflectors arranged two-dimensionally, and light transfer means for conducting said two-dimensional digital imaging light to the recording material, and irradiating the recording material by said digital imaging light for exposure, a shutter means for transmitting and intercepting the light in the optical path from said light source to said recording material is provided, and when said micro-reflectors are driven in order that their reflection angles may be changed over, said shutter means is brought into the state not to transmit the light from said light source.

The tenth printer for a recording material of this invention is a digital printer for a recording material for making the recording material exposed to a digital image, and said printer comprises a light source, means for generating two-dimensional digital imaging light, and light transfer means for conducting said two-dimensional digital imaging light to the recording material, and irradiating the recording material by said digital imaging light for exposure, said light transfer means is subjected to the re-arrangement or the movement of position in order that the number of pixels of said two-dimensional digital imaging light may be increased in one direction, and said recording material is moved relatively in the direction perpendicular to the direction of the increasing of the number of pixels; therefore, an image having a broad width can be formed on said recording material by it, that said light transfer means is subjected to the re-arrangement or movement of position in a manner such that the number of pixels of the digital imaging light based on a single exposure from said light source increases in one direction; and further, because a large-sized image can be formed by making a plurality of exposures to the respective digital imaging lights, it is made possible to form an image having a high image quality, by increasing the number of dots per 2.54 cm (1 inch), even if the number of pixels based on a single exposure is small.

In addition, for the recording material, a silver halide color paper, a film for printing, a radiation-sensitive material for medical use, a recording material for direct plate making, etc. can be cited, but it is not limited to these. Further, for the means for generating two-dimensional digital imaging light, a reflecting means such as a digital micro-mirror device or a D-ILA device can be thought of, but it is not limited to these, and for example, it can be used a liquid crystal panel (transmitting means) having a number of small pieces of liquid crystal (micro-transmitter portion), each of which is capable of independently being controlled for the transmitting state in which light is transmitted and the non-transmitting state in which light is intercepted, arrayed in the row and line directions.

Further, the aforesaid light transfer means has a structure such that it is an assembly of a number of optical fibers, of which the diameter is smaller (the outer diameter is 5 $\mu$m, for example) as compared to the size of one pixel of the digital imaging light (13 $\mu$m square, for example), and light is transferred by a plurality of optical fibers for each pixel of the digital imaging light. It is desirable that the number of pixels is increased in one direction by re-arranging the end, from which light emerges to irradiate the recording material, against the end surface on which the two-dimensional digital imaging light is incident, because it can be prevented a problem such that one pixel of the digital imaging light is not transferred at all, even if one of the optical fibers is broken, for example.

Further, if the aforesaid assembly of the optical fibers has a structure in which a plurality of bundles of optical fibers including a specified number of fibers are used, the shape of the outer circumference of the bundle of the optical fibers at the end portion is made to be a shape such that the orientation of the bundle is capable of being fixed in a specified direction by being provided with a projection or by being made rectangular-shaped, and it has a structure such that the position of each pixel at the end surface of a bundle of optical fibers, from which light emerges to irradiate the recording material, can be made to correspond to that of each pixel at the end surface, on which the digital imaging light is incident, exposure control can be carried out easily because the orientation of the bundles of optical fibers is fixed.

Further, it is desirable that the means for generating two-dimensional digital imaging light comprises a plurality of micro-reflectors, which are integrated two-dimensionally in the row direction and line direction in a manner such that each of their reflection angles is independently controlled, and the irradiation light from the aforesaid light source is reflected by said micro-reflectors; for example, such one as is put on the market with a trade name called DLP by Texas Instruments Inc. in USA and is capable of being controlled for the reflection angle of each micro-reflector electronically can be used for said means for generating the digital imaging light, but it is not limited to this.

Further, in the case where the re-arrangement or movement of position is carried out in order that the number of pixels of the digital imaging light may be increased in one direction, the number of pixels in the direction of the shorter sides is made to be at least 3 or larger, and it is carried out such a control as to obtain the specified amount of exposure by superposing exposures by the 3 or more pixels of the digital imaging light for one pixel point to be exposed on the aforesaid recording material; therefore, the above-described structure is desirable because the defect can be covered by the other pixels, even if, for example, some defect is produced in one pixel owing to poor light transfer etc.

The eleventh printer for a recording material of this invention is a digital printer for a recording material for making the recording material exposed to a digital image, and said printer comprises conveying means for conveying a recording material at an approximately constant speed, and digital exposure means for making an exposure to a digital imaging light on a line-shaped portion in the direction approximately perpendicular to the conveyance direction of said recording material, said printer has a structure such that a circular plate member capable of rotating in connection with the operation of said conveying means is provided, and the moving speed of the outer circumference of said circular plate member is made two or more times of the conveyance speed, it is provided movement detecting means for detecting the amount of movement of said circular plate member moving at said speed of two or more times of the conveyance speed or of a member moving in contact with said circular plate member, and the result of detection by said movement detecting means is used in controlling said digital exposure means; therefore, in the case, for example, where a plurality of lines or teeth for detecting the angle of rotation are provided along the outer circumference of said circular plate member, the pitch can be made large, which makes it possible to raise the precision of detecting the amount of movement.

Further, if the aforesaid conveying means has a roller shaft which is in contact with the recording material directly or through a belt, and the aforesaid circular plate member is fixed at the end portion of said roller shaft, the possibility to produce a rotation lag between the roller shaft and said circular plate member becomes low, and it is possible to improve the precision of detecting the amount of movement.

Further, if the aforesaid roller shaft is made of a metal, and by using a detector capable of confirming the angular position of the aforesaid circular plate member, the fluctuation of the conveyance speed at each of the specified angular positions during one rotation of said roller shaft is measured, and a correction of exposure control is made on the basis of the measured fluctuation of the conveyance speed at each of the specified angular positions, the fluctuation of the conveyance speed based on the deviation of the shape of the roller shaft etc. can be effectively corrected. In addition, it is desirable that said roller shaft is made of a metal, but the material is not necessarily limited to this so long as it secures the stability of the shape.

Further, if the aforesaid digital exposure means comprises means for generating two-dimensional digital imaging light, and light transfer means for conducting said two-dimensional digital imaging light to the recording material, and irradiating the recording material by said digital imaging light for exposure, said light transfer means is subjected to the re-arrangement or movement of position in order that the number of pixels of said two-dimensional digital imaging light may be increased in one direction, and said recording material is moved relatively in the direction perpendicular to the direction of the increasing of the number of pixels of the digital imaging light, an image having a broad width can be formed on the recording material, by said light transfer means being subjected to the re-arrangement or movement of position in order that the number of pixels of said two-dimensional digital imaging light based on a single exposure by the aforesaid light source may be increased in one direction, and further, because a large-sized image can be formed by carrying out plural exposures to the respective digital imaging lights, an image having a high image quality can be formed by increasing the number of dots per 2.54 cm (1 inch), even if the number of pixels based on a single exposure is small.

Further, it is desirable that the aforesaid light transfer means has a structure such that it is an assembly of a number of optical fibers, of which the diameter is smaller as compared to the size of one pixel of the digital imaging light, and light is transferred by a plurality of optical fibers for each pixel of the digital imaging light, and the number of pixels is increased in one direction by re-arranging the end, from which light emerges to irradiate the recording material, against the end surface on which the two-dimensional digital imaging light is incident, because it can be prevented a problem such that one pixel of the digital imaging light is not transferred at all, even if one of the optical fiber is broken, for example.

Further, if the aforesaid assembly of the optical fibers has a structure in which a plurality of bundles of optical fibers including a specified number of fibers respectively are used, and the shape of the outer circumference at the end portion of the bundle of the optical fibers is made to be a shape such that the orientation of the bundle is capable of being fixed in a specified direction, for example, by being provided with a projection or by being made rectangular-shaped, and if it has a structure such that the position of each pixel at the end surface of a bundle of optical fibers, from which light emerges to irradiate the recording material, can be made to correspond to that of each pixel at the end surface, on which the digital imaging light is incident, exposure control can be carried out easily because the orientation of the bundles of the optical fibers is fixed.

Further, it is desirable that the means for generating two-dimensional digital imaging light comprises a plurality of micro-reflectors, which are integrated two-dimensionally in the row direction and in the line direction in a manner such that each of their reflection angles is independently controlled, and the irradiation light from the aforesaid light source is reflected by said micro-reflectors.

Further, it is desirable that, in the case where the re-arrangement or movement of position is carried out in order that the number of pixels of the digital imaging light may be increased in one direction, the number of pixels in the direction of the shorter sides is made to be at least 3 or larger, and it is carried out such a control as to obtain the specified amount of exposure by superposing exposures by the 3 or more pixels of the digital imaging light for one pixel point to be exposed on the aforesaid recording material, because the defect can be desirably covered by the other pixels, even if, for example, some defect is produced in one pixel owing to poor light transfer.

The twelfth printer for a recording material of this invention is a digital printer for a recording material for making the recording material exposed to a digital image, and said printer comprises a light source, means for generating two-dimensional digital imaging light, by reflecting the light from said light source independently by each of the plural micro-reflectors arranged two-dimensionally, and light transfer means for conducting said two-dimensional digital imaging light to the recording material, and irradiating the recording material by said digital imaging light for exposure, it is provided a shutter means for transmitting and intercepting the light in the optical path from said light source to said recording material, and when said micro-reflectors are driven in a manner such that their reflection angles are changed over, said shutter means is brought into the state not to transmit the light from said light source; therefore, it is prevented an imprudent recording owing to the light which is reflected while said micro-reflectors are driven, which makes it possible to record an image having a higher image quality.

Further, if the aforesaid shutter means comprises a rotary member provided between the aforesaid light source and the aforesaid plural micro-reflectors arranged two-dimensionally, said rotary member forming a light transmitting portion and a light intercepting portion, and by rotating said rotary member, said light transmitting portion and said light intercepting portion enter the optical path, an effective image formation becomes possible, because the transmitting and intercepting of light can be controlled at a high speed.

Further, it is desirable that the recording material is a silver halide color recording material, and color filters corresponding to the three colors of blue, green, and red are provided integrally with said shutter, because the structure is more simplified.

Further, assuming that the printer has a structure in which conveying means for conveying a recording material at an approximately constant speed and a circular plate member capable of rotating in connection with the operation of said conveying means are provided, and the moving speed of the outer circumference of said circular plate member is made two or more times of the conveyance speed, and that it is provided movement detecting means for detecting the amount of movement of said circular plate member moving at said speed of two or more times of the conveyance speed or of a member moving in contact with said circular plate member, and the result of detection by said movement detecting means is used in controlling said digital exposure means, in the case, for example, where a plurality of lines or teeth for detecting the angle of rotation are provided along the outer circumference of said circular plate member, the pitch can be made large, which makes it possible to raise the precision of detecting the amount of movement.

Further, if the aforesaid conveying means has a roller shaft which is in contact with the recording material directly or through a belt, and the aforesaid circular plate member is fixed at the end portion of said roller shaft, the possibility of producing a rotation lag between the roller shaft and said circular plate member becomes low, and it is possible to improve the precision of detecting the amount of movement.

Further, if the aforesaid roller shaft is made of a metal, and by using a detector capable of confirming the angular position of the aforesaid circular plate member, the fluctuation of the conveyance speed at each of the specified angular positions during one rotation of said roller shaft is measured, and a correction of exposure control is made on the basis of the measured fluctuation of the conveyance speed at each of the specified angular positions, the fluctuation of the conveyance speed based on the deviation of the shape of the roller shaft etc. can be effectively corrected.

Further, if the aforesaid light transfer means is subjected to the re-arrangement or movement of position in order that the number of pixels of said two-dimensional digital imaging light may be increased in one direction, and the recording material is moved relatively in the direction perpendicular to the direction of the increasing of the number of pixels of the digital imaging light, an image having a broad width can be formed on the recording material, and further, because a large-sized image can be formed by carrying out plural exposures to the respective digital imaging lights, an image having a high image quality can be formed by increasing the number of dots per 2.54 cm (1 inch), even if the number of pixels based on a single exposure is small.

Further, it is desirable if the aforesaid light transfer means has a structure such that it is an assembly of a number of optical fibers, of which the diameter is smaller as compared to the size of one pixel of the digital imaging light, and light is transferred by a plurality of optical fibers for each pixel of the digital imaging light, and the number of pixels is increased in one direction by re-arranging the end, from which light emerges to irradiate the recording material, against the end surface on which the two-dimensional digital imaging light is incident, because a problem such that one pixel of the digital imaging light is not transferred at all can be prevented, even if one of the optical fibers is broken, for example.

Further, if the aforesaid assembly of the optical fibers has a structure in which a plurality of bundles of optical fibers including a specified number of fibers respectively are used, and the shape of the outer circumference at the end portion of the bundle of the optical fibers is such one as to be capable of being fixed for its position, for example, by being provided with a projection or made rectangular-shaped, and if it has a structure such that the position of each pixel at the end surface of a bundle of optical fibers, from which light emerges to irradiate the recording material, can be made to correspond to that of each pixel at the end surface, on which the digital imaging light is incident, exposure control can be carried out easily because the orientation of the optical fibers is fixed.

Further, it is desirable that the means for generating two-dimensional digital imaging light comprises a plurality of micro-reflectors, which are integrated two-dimensionally in the row direction and in the line direction in a manner such that each of their reflection angles is independently controlled, and the irradiation light from the aforesaid light source is reflected by said micro-reflectors.

Further, it is desirable that, in the case where the re-arrangement or movement of position is carried out in order that the number of pixels of the digital imaging light may be increased in one direction, the number of pixels in the direction of the shorter sides is made to be at least 3 or larger, and it is carried out such a control as to obtain the specified amount of exposure by superposing exposures by the 3 or more pixels of the digital imaging light for one pixel point to be exposed on the aforesaid recording material, because the defect can be covered by the other pixels, even if, for example, some defect is produced in one pixel owing to poor light transfer etc.

BRIEF DESCRIPTION OF THE DRAWINGS

Other objects and advantages of the present invention will become apparent upon reading the following detailed description and upon reference to the drawings in which:

FIG. 6 is a perspective view showing the structure according to the second embodiment;

FIG. 7(*a*) and FIG. 7(*b*) are drawings showing a modified example of this embodiment;

FIG. 14(*a*), FIG. 14(*b*) and FIG. 14(*c*) are drawings for explaining the fourth embodiment;

FIG. 15 is a drawing for explaining the fifth embodiment;

FIG. 19(*a*) is the upper end surface view, FIG. 19(*b*) is the front view, and FIG. 19(*c*) is the lower end surface view;

FIG. 22(*a*) and FIG. 22(*b*) are drawings showing another modified example.

DETAILED DESCRIPTION OF THE PREFERRED EMBODIMENT

In the following, the embodiments of this invention will be explained with reference to the drawings. In addition, with respect to this embodiment, an example in which a digital micro-mirror device is used for the reflecting means will be shown; however, it is also possible to use a D-ILA device having a small micro-reflectors of which the reflection angle of each can be independently controlled or other device as the reflecting means.

Figure 1:
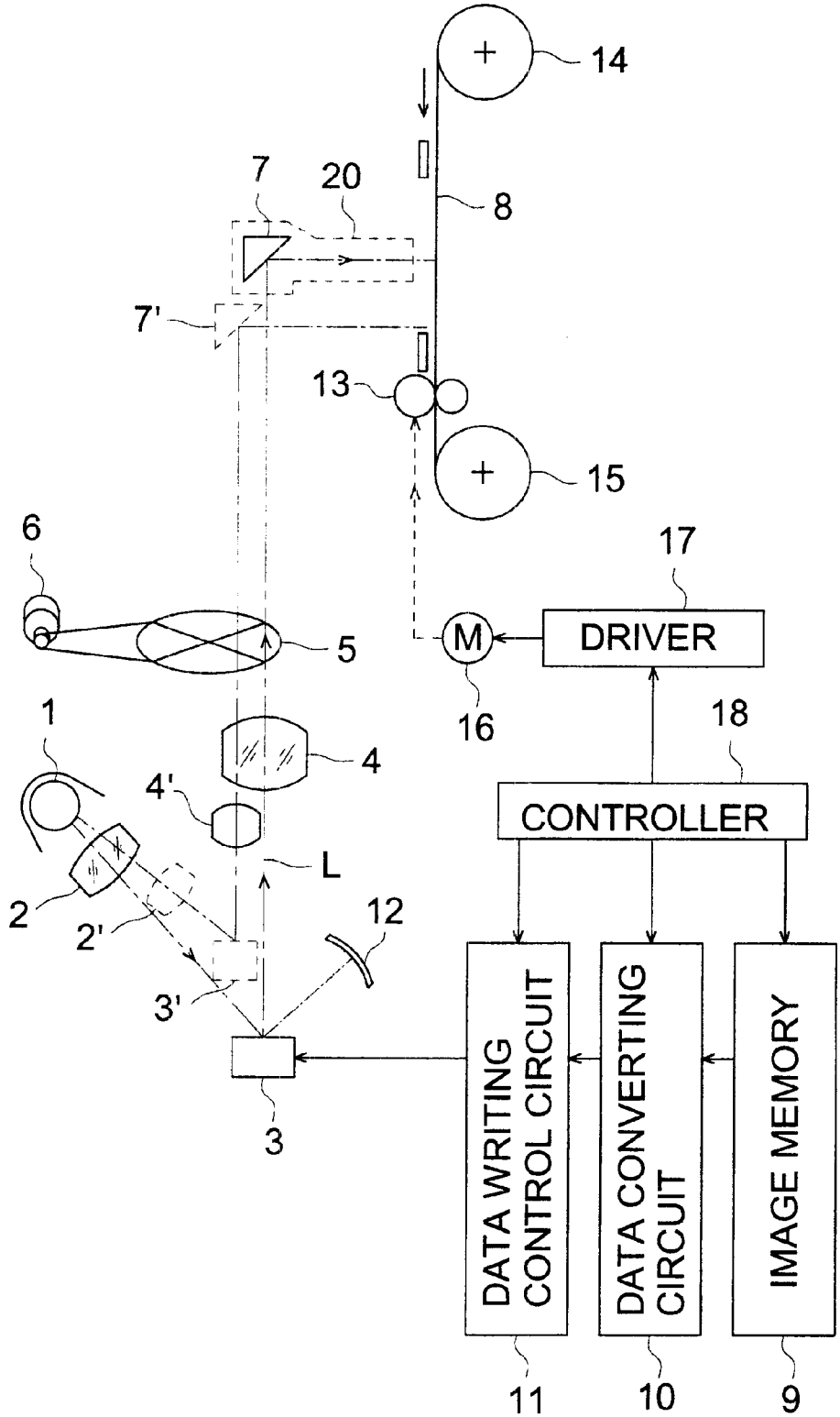
FIG. 1 is a drawing showing the outline of a printer for a recording material according to an embodiment of this invention.

FIG. 1 is a drawing showing the outline of a printer for a recording material according to an embodiment of this invention. The white light emitted from the light source 1 is incident on the digital micro-mirror device 3 as recording light, after being made parallel by the lens 2 as an optical system. On the upper side of this digital micro-mirror device 3, a large number of micro-mirrors (not shown in the drawing) as the small reflectors are arranged in an array in the row direction and in the line direction.

In the digital micro-mirror device 3, each micro-mirror is put in the horizontal state while the electric power source is turned off, and is tilted by an angle $+\theta$ or $-\theta$ with respect to the vertical axis, in accordance with the value of the driving data of 1 bit written in a memory cell. If the micro-mirror reflects the light from the light source 1 to the direction in which the light enters the recording material when the tilt angle is +θ, and it reflects the light to the direction in which the light does not enter the recording material when the tilt angle is −θ, +θ represents the effective reflection state, and −θ represents the ineffective reflection state. The spot (reflected) light reflected to the direction in which it enters the recording material is projected toward the projector lens 4 as an objective optical system.

The spot light having passed the projector lens 4 passes the color filter 5 having the four transmitting portions consisting of red, green, blue, and achromatic portion. The color filter 5 has a shape of a circular plate capable of freely rotating and is capable of being rotated by the drive means 6 in accordance with the image to be formed; further, the drive means 6 is controlled by the controller 18 to be described later.

The light spot having passed the color filter 5 is reflected by the mirror (or a prism) 7 as a splitting means, and comes onto the recording material 8. The recording material 8 is nipped by the conveyance roller pair 13, being drawn out intermittently from the supply roll 14 for every one frame, and is fed to the take-up roll 15. The pulse motor 16 for rotating the conveyance roller pair 13 is controlled for its rotation by the controller 18 through the driver 17.

In the image memory 9, image data for one frame is written, and the image data are read out at the time of image formation and are transmitted to the data converting circuit 10. In this data converting circuit 10, the mirror driving data "1" is converted into a value in accordance with the value of image data. The data writing control circuit 11 writes the mirror driving data in an SRAM (not shown in the drawing) of the digital micro-mirror device 3 in synchronism with the write timing signal.

A micro-mirror of the digital micro-mirror device 3 is brought into the ineffective reflection state when it is tilted by −θ by the mirror driving data "0", and reflects the spot light from the light source 1 toward the light absorbing plate 12. Because this reflected light is unnecessary, it is absorbed by the light absorbing plate 12 so as not to make the recording material 8 sensing the light.

If the mirror driving data is "1", the micro-mirror is brought into the effective reflection state in which it is tilted by +θ, and it can reflect the spot light toward the projector lens 4.

Figure 2:
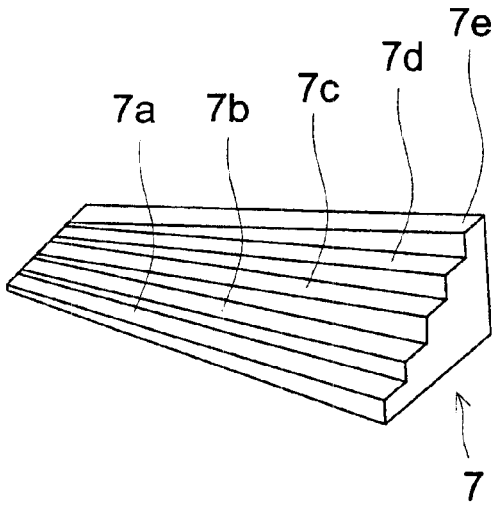
FIG. 2 is a perspective view showing the mirror 7.

FIG. 2 is a perspective view of the mirror 7. The mirror 7 as a splitting means is nearly step-shaped but has reflection surfaces 7*a* to 7*e* each of which is tilted. The reflection surfaces 7*a* to 7*e* are capable of reflecting the spot lights reflected by the micro-mirrors located in the predetermined lines (longitudinal) and rows (lateral) respectively.

Figure 17:
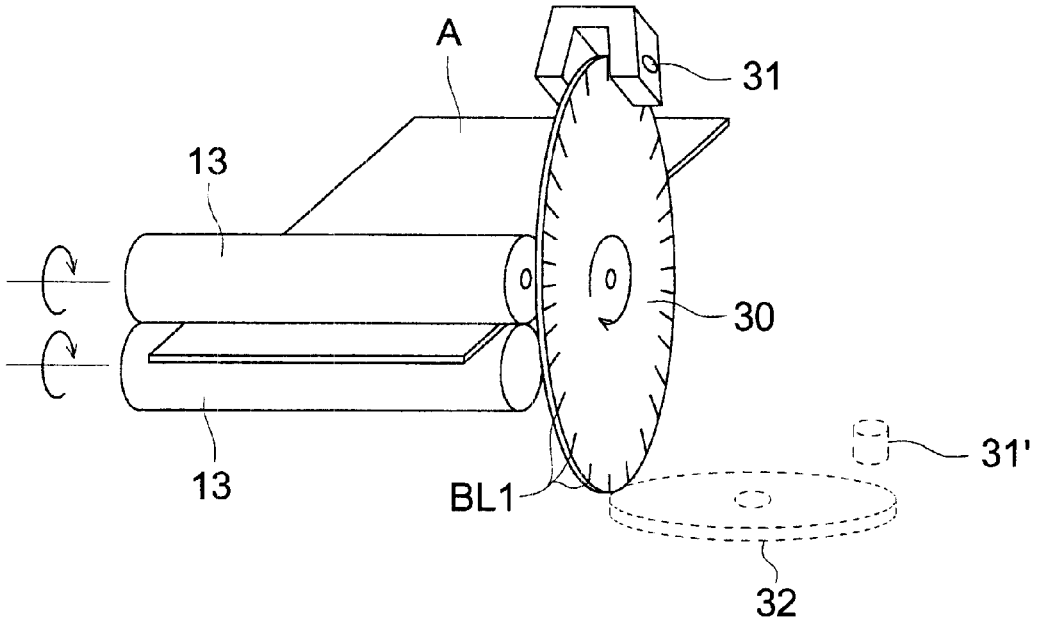
FIG. 17 is a perspective view showing the conveyance roller pair 13 composing the conveying means.

FIG. 17 is a perspective view showing the conveyance roller pair 13 composing the conveying means. The pair of roller shafts 13 made of a metal is capable of conveying the recording material 8, which is a silver halide color recording material, being driven by a motor (not shown in the drawing). At the end portion of one of the roller shafts 13, the circular plate member 30 is directly fixed. On the edge portion along the outer circumference of the circular plate member 30, short black lines BL1 are formed at equal intervals. In addition, it is desirable that the outer diameter of the circular plate member 30 is two or more times of the outer diameter of the roller shaft 13.

At a position opposite to the edge portion along the outer circumference of the circular plate member 30, the light sensor 31 comprising a detecting portion (not shown in the drawing) is provided. The light sensor 31 is connected to the controller 18, and outputs a signal when any one of the black lines BL1 crosses the detecting portion.

Figure 18:
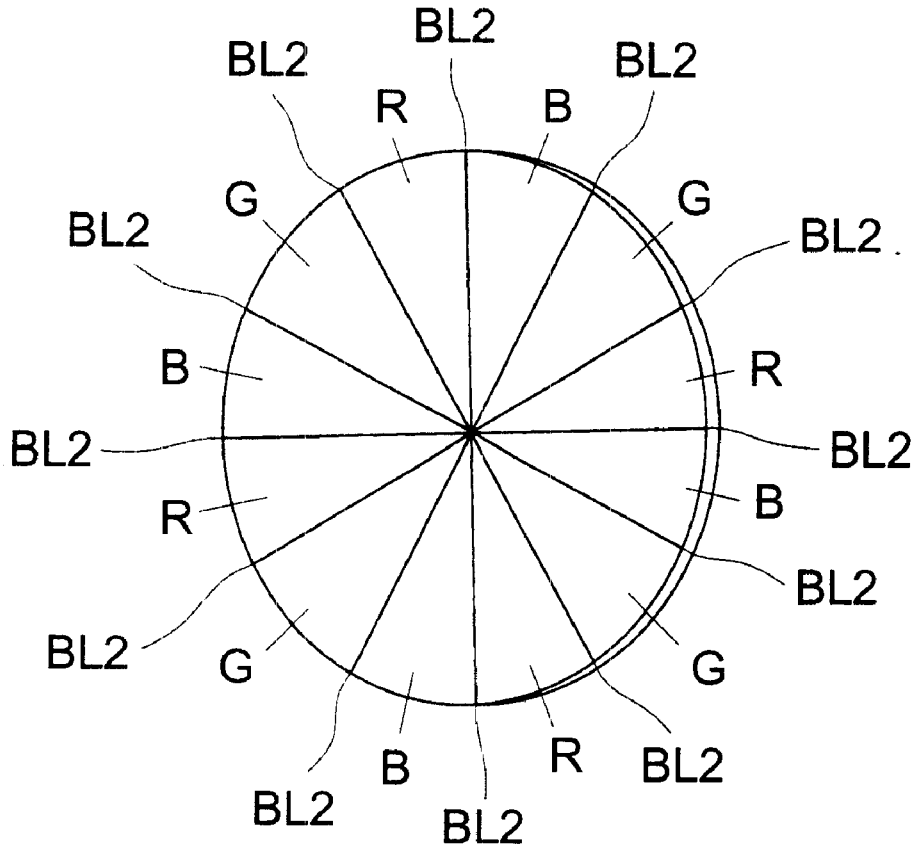
FIG. 18 is a perspective view showing the color filter-cum-shutter 5.

FIG. 18 is a perspective view of the color filter-cum-shutter 5. The color filter-cum-shutter 5 as a shutter means is made of a transparent resin plate, and is colored in the order of blue (B), green (G), and red (R) repeatedly in the circumferential direction; at the borders of those, the black lines BL2 are formed. Moreover, the portions colored in blue (B), green (G), and red (R) respectively form the transmitting portions, and the black lines BL2 form the non-transmitting portions.

In the following, the operation of a printer for a recording material according to this embodiment will be explained. When the electric power source (not shown in the drawing) is turned on, the controller 18 give the data writing control circuit 11 the instruction to clear the digital micro-mirror device. The data writing control circuit 11 writes "0"s in the SRAM of the digital micro-mirror device 3, to bring every micro-mirror into the ineffective reflection state by tilting it by −θ.

Next, the controller 18 makes the light source 1 turned on. The white light from this light source 1 is converted into a parallel bundle of rays by the collimator lens 2, and it illuminates the upper surface of the digital micro-mirror device 3 from an oblique direction. At this time, "0" has been written in every memory cell of the SRAM of the digital micro-mirror device, and every micro-mirror has been brought into the ineffective reflection state; therefore, the spot lights reflected by the respective micro-mirrors are reflected toward the light absorbing plate 12.

The controller 18 reads out image data (for example, the first portion of image data of one frame divided into 10 portions) from the memory 9 and transmits the data to the data converting circuit 10. This data converting circuit 10 converts every image data into the mirror driving data of N bits. This mirror driving data includes a number of "1"s, said number corresponding to the value of the image data. With respect to the mirror driving data of every image, the minimum bit for each pixel is taken out and transmitted to the data writing control circuit 11, by which it is written in the SRAM of the digital micro-mirror device 3.

Every micro-mirror is brought into the effective reflection state when it is given the mirror driving data of "1", and reflects the spot light toward the image forming optical path L. This spot light is projected to the recording material 8 by the projector lens 4. Further, the spot light having been collected by the projector lens 4 passes the color filter 5, being converted into the light having the specified color, and further, is reflected by the mirror 7 toward the recording material 8, to make the recording material exposed to it as the digital imaging light.

Further, in a printer for a recording material according to this embodiment, it is also carried out that, by detecting the reflected light by the digital micro-mirror device 3 by a light sensor (not shown in the drawing) and comparing it with the initial state, at the time of turning-on or periodically, for example, variation of the light quantity of the light source 1 with the passage of time and the lowering of the light quantity owing to the smudging of the micro-mirrors etc. are obtained, and the correction for these are automatically made.

Further, it is desirable that the light sensor is provided at the position to which light is reflected by the micro-mirror device when the light does not irradiate the recording material, or a method in which the light sensor is provided under the path of the recording material, and in the case where the recording material is not processed, the reflected light is detected by controlling the digital micro-mirror device.

It is more desirable a structure in which the correction can be made for each of the micro-mirrors by a single light sensor being moved by a motor for a line exposure in order that it can receive a spot light from every micro-mirror. Further, in this case, by the feedback of control, it is carried out an inter-pixel correction for a situation where the optical axis of a mirror a little deviates, which makes it possible to always obtain a fine image. In the case of a color recording material, it is desirable for the light sensor to detect the light for each of the colors blue, green, and red.

Figure 3:
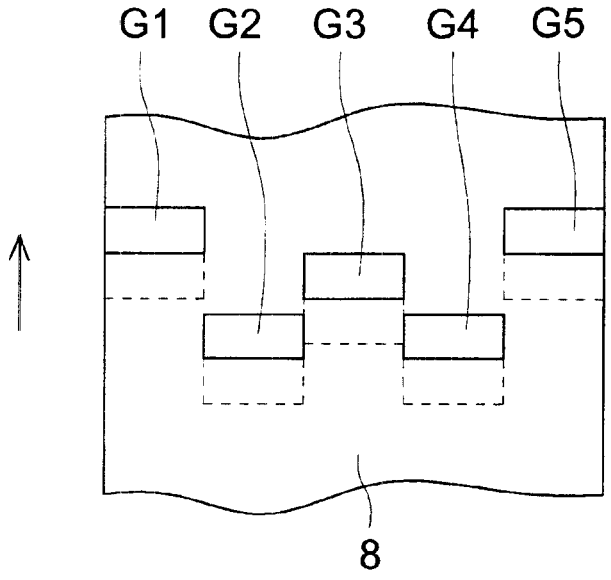
FIG. 3 is a drawing showing the mutual positional relation of the digital imaging lights G1 to G5 applied to the recording material 8.

FIG. 3 is a drawing showing the mutual positional relation of the partial digital imaging lights G1 to G5 irradiating the recording material 8. Because the reflection surfaces 7*a* to 7*e* of the mirror 7 have a shape of a long and narrow rectangle and are tilted in the specified direction, as shown in FIG. 3, the partial digital imaging lights G1 to G5 also have a shape of long and narrow rectangle, and are arranged in the direction crossing the moving direction (the direction of the arrow mark in FIG. 3) of the recording material 8. In this case, by bringing the partial digital imaging lights G1 to G5 into a positional relation such that [they overlap one another] their edge portions along the sides parallel to [with respect to] the moving direction of the recording material overlap one another, an image without discontinuity can be formed. When the recording material 8 is moved further, the portions shown by the dotted lines of the recording material 8 are exposed respectively to the partial digital imaging lights G1 to G5 for the next image data (the second portion of the image data divided into ten portions), and by repeating this, an image having a broad width can be formed while it keeps a high definition. In addition, instead of the mirror 7, a prism with inner reflection surfaces formed stepwise in the same way can be used.

Further, by adjusting the mirror 7 in a manner such that the digital imaging light forms an image on any one of the reflection surfaces 7*a* to 7*d* of the mirror 7 or on a surface in the neighborhood of them by using the projector lens 4, an image having a higher definition can be obtained.

Figure 4:
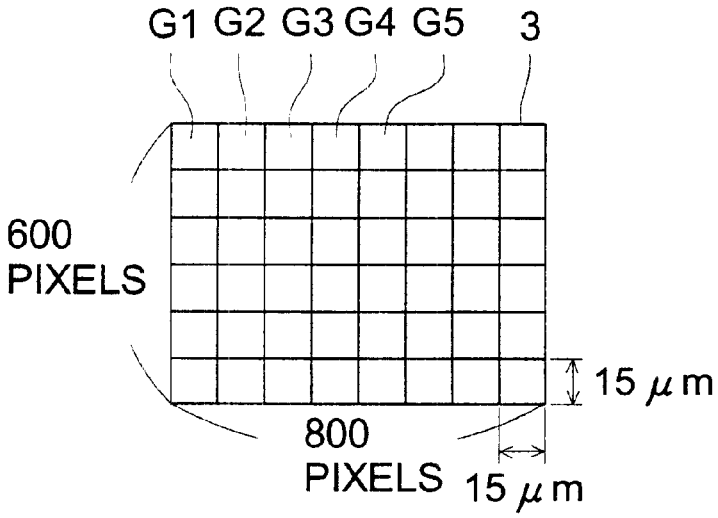
FIG. 4 is a drawing showing a modified example of this embodiment.
Figure 5:
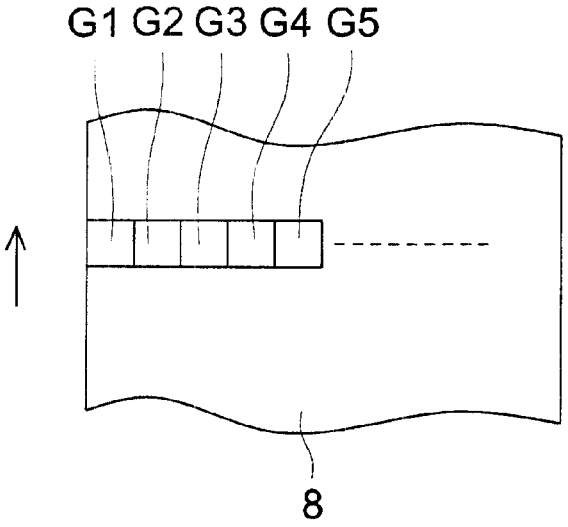
FIG. 5 is a drawing showing a modified example of this embodiment.

FIG. 4 and FIG. 5 are drawings showing modified examples of this embodiment. As shown in FIG. 4, if it is done that the digital imaging light reflected by the micro-mirrors of the micro-mirror device 3 is split into bundles of rays having approximately the shape of a square by the mirror 7, and as shown in FIG. 5, they are arrayed in the direction perpendicular to the moving direction of the recording material 8, to irradiate the recording material, an image having a broader width can be formed. Further, in the case where a lens is provided between the mirror 7 and the recording material 8, the diameter of this lens can be made small by the above-described structure, and a small-sized structure of low cost can be provided.

FIG. 6 is a perspective view showing a structure according to the second embodiment. In the embodiment shown in FIG. 6, the point that is different from the first embodiment is mainly that optical fibers are used instead of the mirror 7; therefore, the structure which is common to both will not be explained.

In FIG. 6, a large number of the optical fibers 20 have the upper end side directed to the micro-mirror device 3 (FIG. 1) and the lower end side directed to the photosensitive surface of the recording material 8. The assembly of the optical fibers 20 is made to have a shape similar to the digital micro-mirror device 3 at the upper end side, and is made to be line-shaped in the direction perpendicular to the moving direction of the recording material 8 at the other end side. In addition, between the optical fibers 20 and the recording material 8, the SELFOC lens 21 is disposed.

According to this embodiment, because the spot lights from the digital micro-mirror device 3 are transmitted by the respective optical fibers, an image having a broad width can be formed without enlarging the pixel size. In addition, if the shape of the other end of the optical fibers 20 is made line-shaped, the number of pixels in the moving direction of the recording material 8 is decreased; however, it does not make a problem particularly, because an image having an arbitrary size can be formed by moving the recording material 8.

Further, by making the projector lens 4 provided between the digital micro-mirror device 3 and the optical fibers 20 form the image of the digital imaging light on the upper side of the optical fibers 20, an image having a higher image quality can be formed by using the digital imaging light emerging from the other end of the optical fibers 20.

For example, in the case where a micro-mirror of the micro-mirror device 3 has a size of 16 $\mu$m square, if it is made to form its image by a lens on the end surface of the optical fibers with a reduced size of 4 $\mu$m square, and optical fibers having a diameter of 2 $\mu$m are used, an exposure of higher definition than that based on the pixels comprised in the digital micro-mirror device becomes possible. On the other hand, the size of 4 $\mu$m square makes it possible to actualize a high-definition image of about 5000 dpi, even if some deterioration of pixel occurs on the way of the transmission of the digital imaging light.

In addition, it has been known that, for a silver halide color paper, 600 dpi (600 pixels per 2.54 cm (1 inch)) is equivalent to the number of pixels comprised by the color paper itself, and even if the dots are made finer than that, an image having a so high image quality can not be expected. In this connection, 600 dpi means the pixel of about 41 $\mu$m square or circle. In this case, assuming that, for example, the diameter of the optical fiber is 10 $\mu$m and a micro-mirror of the digital micro-mirror device has a size of 15 $\mu$m square, by forming the image on the one end surface of the optical fibers with the size enlarged to 30 $\mu$m square by a lens, the recording with 600 dpi can be carried out.

Further, [if] because the SELFOC lens 21 is disposed between the optical fibers 20 and the recording material 8, the scattering of light and the enlargement of the imaging light are prevented at the time of the irradiation of the recording material by the digital imaging light from the optical fibers 20, and an image having a higher image quality can be formed.

Figure 8:
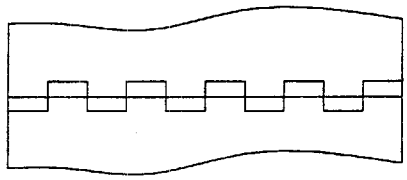
FIG. 8(*a*), FIG. 8(*b*) and FIG. 8(*c*) are drawings showing a modified example of this embodiment.
Figure 8:
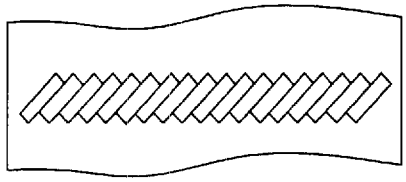
Figure 8:
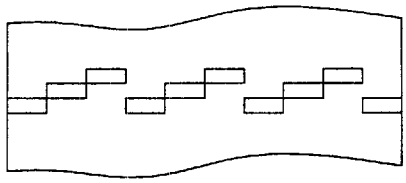

FIG. 7(*a*), FIG. 7(*b*), FIG. 8(*a*), FIG. 8(*b*) and FIG. 8(*c*) are drawings showing modified examples of this embodiment. The optical fibers 20' shown in FIG. 7(*a*) form a bundle having a shape of a rectangle which is long and narrow in the lateral direction, and the thickness A in the vertical direction is approximately equal to the length of the specified number of rows of the array of the micro-mirrors corresponding to the ⅕ division of the digital micro-mirror device 3 in the vertical direction. As shown in FIG. 7(*b*), such optical fibers 20' are used in a plurality (5 in this case) of such bundles layered in the vertical direction in order that the thickness may be equal to the length of the vertical lines of the micro-mirrors in the micro-mirror device 3. On the other hand, the end portion of the optical fibers 20' directed toward the recording material is arrayed in a row in the longer side (lateral) direction, that is, in the direction perpendicular to the moving direction of the recording material. Moreover, because the optical fibers 20' are easy to bend, the arrangement at the other end side can be done arbitrarily, and for example, with an arrangement shown in FIG. 8(*a*) to FIG. 8(*c*), the digital imaging light can be applied to each bundle.

For example, if the optical fibers 20 are arranged at random, the relation of correspondence between the micro-mirrors of the digital micro-mirror device 3 and the image formed on the recording material 8 can not be obtained, and the conversion of the digital data becomes troublesome. In contrast with this, if the optical fibers 20 are divided into a plurality of blocks (bundle 20'), by confirming the relation at the time of operation, the conversion of the digital data can be easily made.

In this case, it is desirable that the shorter sides of the bundle formed at the other end side of the bundle of optical fibers 20' are arranged in such a manner as to agree with the moving direction of the recording material 8, and further, the respective shorter sides of the bundles which are adjacent to each other are brought into contact or overlapping.

Further, if each of the plural bundles of optical fibers 20' includes a specified number (for example, a comparatively small number from 100 to 10,000) of optical fibers which are the same for each of them, by forming such partial bundles, it is possible that the handling of them is simplified and the adjustment of the position for exposure is made easy. Further, manufacturing of the apparatus can be made easy, and the conversion of data can be simplified.

Figure 9:
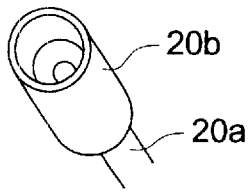
FIG. 9 is a perspective view showing the light intercepting layer 20*b* for reflecting, absorbing, or intercepting light, provided on the circumference at the end portion of one optical fiber 20*a;*

Further, as shown in FIG. 9, by providing the light intercepting layer 20*b* for reflecting, absorbing, or intercepting light on the outer periphery at the end portion of an optical fiber 20*a*, the mixing of the spot lights of the digital imaging light between the neighboring two or more optical fibers 20*a* can be prevented, and the lowering of image quality owing to the mixing of the spot lights can be prevented.

Figure 10:
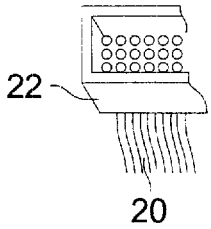
FIG. 10 is a partial perspective view showing the light intercepting layer 22 for reflecting, absorbing, or intercepting light provided at the end portion of a bundle of the optical fibers 20'.

Further, as shown in FIG. 10, by providing the light intercepting layer 22 for reflecting, absorbing, or intercepting light on the outer periphery at the end portion of the bundle of the optical fibers 20', the mixing of the partial digital imaging lights between the neighboring two or more bundles of optical fibers is prevented, and the lowering of image quality owing to the mixing of lights can be prevented.

Further, if the sensor 23 (refer to FIG. 6) as a detecting means for detecting the light emerging from the other end of the optical fibers 20 is provided, and while the recording material 8 is not conveyed, the spot lights from the optical fibers 20 are detected, and by carrying out the adjustment of the micro-mirrors of the digital micro-mirror device 3 or the conversion of image data in accordance with the result of the detection, a desired image can be formed.

For example, in the case where light is transmitted by using the bundle of the optical fibers 20, by obtaining the relation between each of the micro-mirrors and the exposure position of the recording material 8 by the sensor 23, and by carrying out the conversion of the digital data on the basis of this detection result, a desired image can be formed. Accordingly, adjustments such as the correction of positional deviation of an image become easy. Moreover, for such a detection, it can be thought of a mode in which the adjustment of the sensor using a fixture for inspection at the time of installment of the printer for a recording material, or a mode in which the sensor is built in beforehand to the printer for a recording material, and an automatic correction is carried out periodically, for example, at the time of the turning-on of the electric power source.

Figure 11:
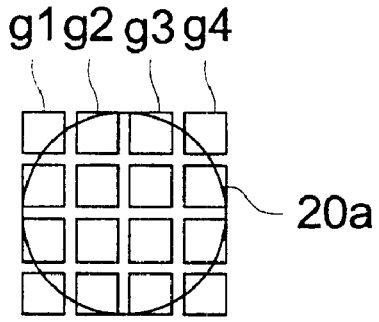
FIG. 11 is a drawing showing the positional relation between the optical fiber 20*a* and a plurality of light beams of the digital imaging light from a plurality of micro-mirrors.

Further, as shown in FIG. 11, it is also appropriate that, in order to make the spot lights from a plurality of micro-mirrors g1, g2, - - - enter into the single optical fiber 20*a*, the diameter of the optical fiber 20*a* is made to be equal to or larger than several times of the spot light, that is, the pixel size of the micro-mirror.

Figure 12:
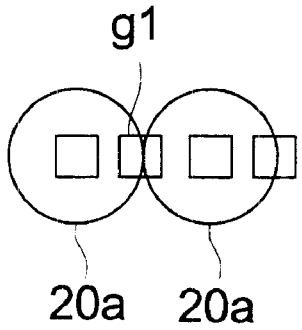
FIG. 12 is a drawing showing the positional relation between the optical fibers 20*a* and a plurality of light beams of the digital imaging light from a plurality of micro-mirrors.

On the other hand, as shown in FIG. 12, in the case where the spot light g1 from a certain micro-mirror enters into a plurality of optical fibers 20*a* and 20*a*, if a control is made in order that the spot light g1 from said certain micro-mirror may not irradiate the recording material 8, by making said certain micro-mirror not to be used, the lowering of image quality owing to the confusion of the digital imaging light can be prevented.

Figure 13:
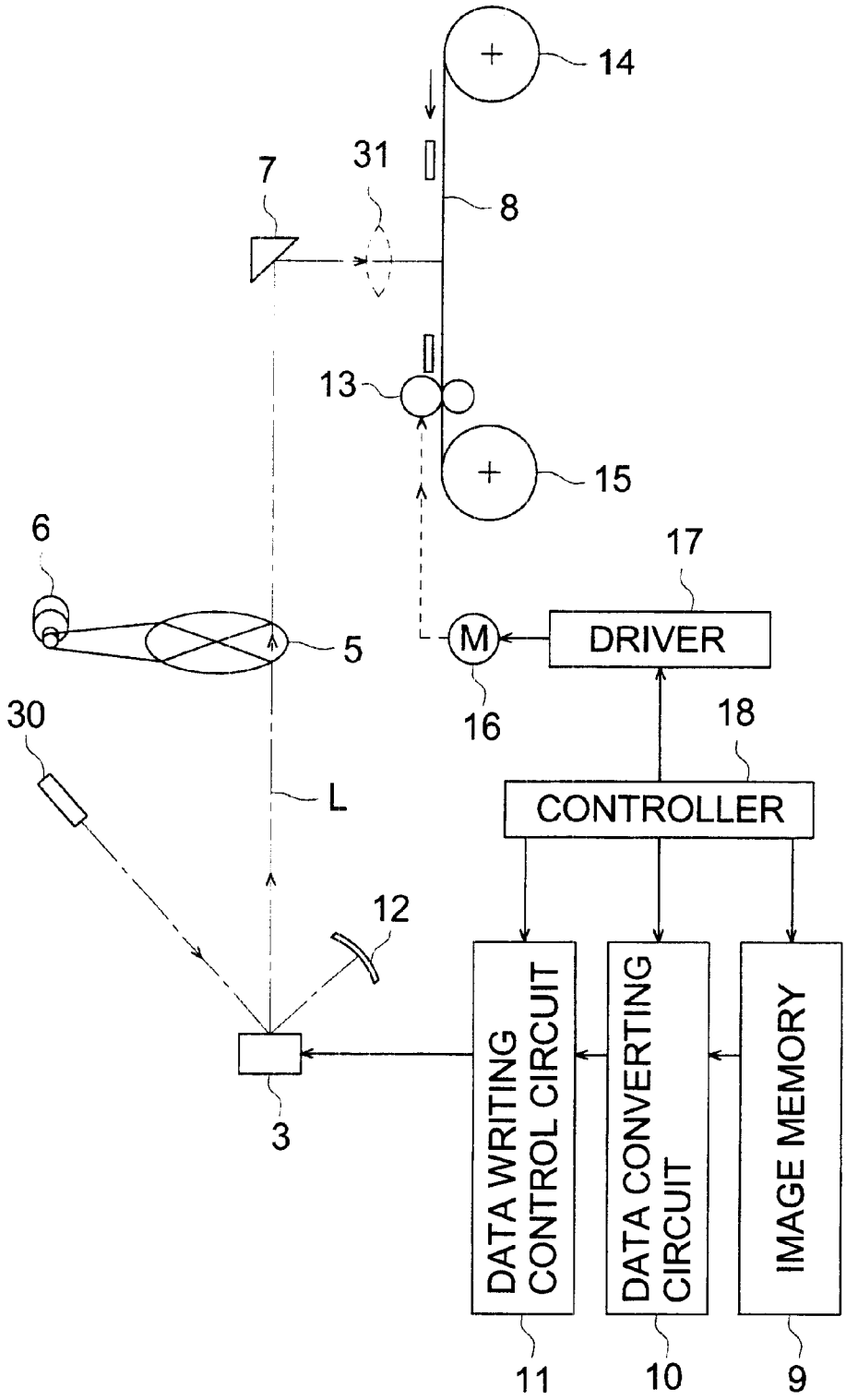
FIG. 13 is a drawing similar to FIG. 1 showing a printer for a recording material according to the third embodiment.

FIG. 13 is a drawing similar to FIG. 1 showing a printer for a recording material according to the third embodiment. In this embodiment, the laser light source 30 is used instead of the light source 1. Owing to that, the lens 2 and the projector lens 4 is eliminated, but because the other structure is common to both, the explanation will be omitted. In addition, optical fibers may be used instead of the mirror 7.

According to this embodiment, an image can be formed by using a laser beam which is a stable parallel light, and lens etc. becomes unnecessary, which makes it possible to simplify the structure. In the case of a usual laser exposure, there is a problem that non-uniformity in exposure is easy to occur owing to vibration, because the laser beam is applied by rotating a polygonal mirror at a high speed. However, according to this embodiment, a structure capable of withstanding vibration can be provided, because there is no movable portion except the digital micro-mirror device.

Moreover, as shown by the dotted lines, by providing the lens 31 (means for conducting the reflected light) for reducing the digital imaging light from the digital micro-mirror device 3 before it is applied to the recording material 8, an image having an arbitrary size can be formed.

Further, if a lens is inserted between the digital micro-mirror device 3 and the recording material 8, and the digital imaging light reflected by said digital micro-mirror device 3 is made to form the image of the micro-mirrors on the recording material or on its neighborhood to make an exposure, an image having a higher image quality can be formed.

Further, in the case where the cross-sectional area of the irradiating laser beam is smaller as compared to the array of micro-mirrors, if a lens is provided between the light source of the irradiation laser beam and the digital micro-mirror device, by applying the laser beam to the micro-mirror device with the cross-sectional area of the irradiation laser beam enlarged, it is possible to make the cross-sectional area of the laser beam equivalent to the size of the array of micro-mirrors, and for example, by using a low-priced laser beam, an image having a high image quality can be formed.

It is thought of that, for the embodiment shown in FIG. 1, by separately providing the lenses 2' and 4', the digital micro-mirror device 3', and the mirror 7' as shown by the dotted lines, light from a single light source is conducted to the recording material 8 through a plurality of paths. According to this structure, even if the [size] number of the micro-mirrors of the digital micro-mirror device is small, an image can be formed by dividing, and the moving speed of the recording material can be made high; therefore, an image having a higher image quality can be formed at a high speed.

FIG. 14 is a drawing for explaining the fourth embodiment. As shown in FIG. 14(*a*), the partial digital imaging lights G1 and G2 are applied onto the recording material with their end portions overlapped each other. However, in the case where the gradation of the image is constant, if the light quantity of the partial digital imaging lights G1 and G2 are not varied, the amount of exposure at the overlapping portion S increases, and an image with unevenness of density produced by non-uniform exposure is to be formed.

Therefore, in this embodiment, the light quantity of each of the partial digital imaging lights G1 and G2 is made to be decreased in the area corresponding to the overlapping portion S to a half, for example, by controlling exposure time, and owing to it, an image having a high image quality without unevenness of density produced by non-uniform exposure.

Further, in the case where the image to be formed has a uniform gray level, if the sum of the light quantity obtained by the overlapping of a part of each of the neighboring reflected beams is approximately equal to the light quantity of the remaining non-overlapping portion of each beam, the proportion of the light quantity in the overlapping portion can be made to be an arbitrary value which is larger than 0 and smaller than 1, by doing in this way, an image having a high image quality can be formed. In addition, if the proportion is made 0 or 1, it is possible that a streak-shaped unevenness is produced.

FIG. 15 is a drawing for explaining the fifth embodiment. In the fifth embodiment, the cross-section of the digital imaging light G1 is compressed in the vertical direction, that is, in the moving direction of the recording material 8 desirably to one third. As for this compression, it can be thought of that the cross-section of the digital imaging light is compressed through a cylindrical lens before it is applied to the recording material 8, but it may be done by image processing. When the digital imaging light G1' having been compressed in this way is applied onto the recording material 8, a normal image (the vertical-to-longitudinal ratio is 1:1) can be obtained, for example, by moving the recording material at a constant speed. Owing to it, an intermittent movement such as, for example, stopping the recording material 8 every time for exposure becomes unnecessary, and the structure for moving the recording material 8 is more simplified.

Further, it is desirable that the printer has a structure such that the digital imaging light reflected by the digital micro-mirror device is applied onto a line-shaped area.

Further, in the embodiment shown in the structure of FIG. 1, the color filter 5 comprises the portions transmitting blue, green, red, and achromatic light respectively, and the portion for transmitting the aforesaid white light is changed over in accordance with the image to be formed; therefore, in comparison with the case where a filter comprising portions transmitting three colors respectively is used, the density of black area of the recording material 8 is raised by providing the portion transmitting achromatic light, and an image having little color spreading can be formed.

Further, the color filter 5 has a shape of a circular plate capable of freely rotating, the areas obtained by dividing the whole area into four form the portions transmitting blue, green, red, and achromatic light respectively, and a driving means for rotating said color filter in accordance with the image to be formed is provided; therefore, the changing-over of the color can be easily carried out.

Figure 16:
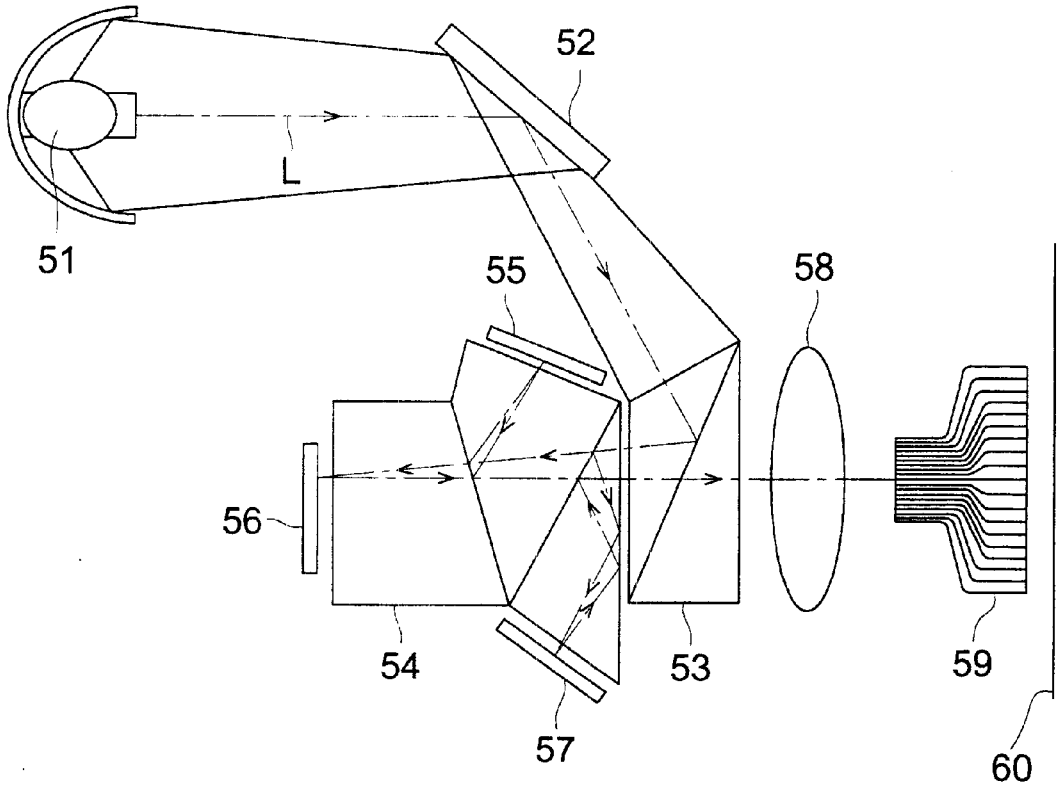
FIG. 16 is a drawing for explaining the sixth embodiment.

FIG. 16 is a drawing for explaining the sixth embodiment. In the sixth embodiment, a digital micro-mirror device is used for every color. To state it more concretely, the irradiation light L from the light source 51 is reflected by the mirror 52, and enters the color separating-combining prism 54 through the TIR (total reflection) prism 53. By the color separating-combining prism 54, the irradiation light L is separated into colors (blue, green, and red), and reflected by the respective digital micro-mirror devices 55, 56, and 57.

At this time, only the necessary micro-mirrors of the digital micro-mirror devices 55, 56, and 57 are brought into the effective reflection state, and by making a design such that the reflected bundles of rays from these mirrors have a common optical axis, a desired color image is to be composed. These reflected bundles of rays are converged by the projector lens 58 onto the one end of the optical fibers 59 to form the image, which is transmitted through the optical fibers 59, and is applied to the recording material 60 from the other end. According to this embodiment, it is not necessary to use a color filter, and the structure can be more simplified; and on top of it, it is possible to make efficient the processing of image formation on the recording material.

As has been explained up to now, according to this invention, by using a digital micro-mirror device, a D-ILA device, or the like, it can be provided, a printer for a recording material capable of forming an image on a recording material having a broader width, while maintaining an image quality of a certain constant level.

Next, in the above-described first embodiment in which the circular plate member 30 is used, in response to the signal outputted every time when any one of the black lines BL1 of the circular plate 30 passes the front of the detecting portion of the light sensor 31 as a movement detecting means, the controller 18 drives the digital micro-mirror device 3, the pulse motor 16, and the roller shafts 13, to make it possible to apply a digital imaging light onto the recording material 8. Even if a fluctuation of speed occurs in the driving system for driving the roller shafts 13, by feeding back the result of detection by the light sensor 31, the deviation of the exposure position based on the fluctuation of speed can be prevented by varying the exposure timing. At this time, because the outer diameter of the circular plate member 30 is as large as two or more times of the outer diameter of the roller shaft 13 (that is, the peripheral speed is two or more times), the pitch of the black lines BL1 can be made large, and owing to it, the precision of detection of the amount of movement can be raised. In addition, instead of forming black lines BL1 on the edge portion along the outer circumference of the circular plate member 30, it is appropriate to form teeth at equal intervals.

Further, the roller shafts 13 may be brought into contact with the recording material 8 with a belt (not shown in the drawing) put in between instead of a direct contact. Because the circular plate member 30 is fixed directly to the end portion of one of the roller shafts 13, there is lower possibility of producing a rotation lag in comparison with the case where the circular plate member 30 is coupled through a transmission mechanism, and the precision in detecting the amount of movement can be more raised. However, in the case where the space for disposing the circular plate member to the roller shaft 13 can not be secured, it is appropriate to couple the circular plate member 30 to the roller shaft 13 with gears. Further, as shown by the dotted lines in FIG. 17, it is also possible, by providing the member 32 which is capable of rotating in contact with the circular plate member 30 and have black lines formed at equal intervals on the edge portion along the outer circumference and detecting the rotating speed of this member 32 by the light sensor 31', to obtain the rotating speed of the roller shaft 13 on the basis of it.

Further, if the pitch of the black lines BL1 of the circular plate member 31 is made finer, by using the light sensor 31 as a detector, it is also possible to measure the fluctuation of the conveyance speed which is peculiar to the roller shaft 13. To state it more concretely, it is thought of that, on the basis of the basic position of the circular plate member 30 which has been determined beforehand, by using the light sensor 31, it is measured the fluctuation of conveyance speed in terms of the angle measured from the above-described basic position when the roller shaft is let to make one rotation before exposure, and the measured fluctuation of conveyance speed is memorized by the controller, which carries out the correction of the exposure control at the time of actual exposure. Owing to it, the fluctuation of the conveyance speed based on the deviation of the shape of the roller shafts 13, etc. can be effectively corrected. In addition, from the view point of the stability of shape, it is desirable that the above-described roller shafts are made of a metal, but so long as the stability of shape is secured, the material is not limited to this.

Incidentally, the micro-mirrors are capable of moving between the effective position for making effective reflection and the ineffective position for making ineffective reflection; if they reflect the light from the light source 1 in the midway of the effective position and the ineffective position, this reflected light becomes stray light, and there is a possibility for the stray light, for example, to be sensed by the recording material unexpectedly. In particular, in the case where the exposure time of one time is comparatively long, sometimes the stray light produced at the time of driving the digital micro-mirror device can be neglected; however, in the case where a short time exposure is carried out by increasing the light quantity of the light source 1 in order to make the print speed high, it is a problem how to handle this stray light for keeping image quality high. Therefore, in this embodiment, in the case where the micro-mirrors are in process of being driven and at neither the effective position nor the ineffective position, the transmission of the spot lights is prevented by using the color filter-cum-shutter 5.

To state it more concretely, the color filter-cum-shutter is controlled in such a manner as to be rotated in synchronism with the roller shafts 13. For example, as shown in FIG. 3, the partial digital imaging lights G1 to G5 irradiate the surface of the recording material 8 simultaneously; at this time, first the digital micro-mirror device 3 is driven, to let the micro-mirrors corresponding to the blue component of the image move to the effective position, and by letting the light be transmitted through the blue filter portion (B) of the color filter-cum-shutter 5, exposure for the blue component is carried out. Successively, the procedure enters into the preparation for it, that the digital micro-mirror device 3 is driven to let the micro-mirrors corresponding to the green component of the image move to the effective position.

At this time, when the color filter-cum-shutter 5 is rotated in order to change over the transmitting portions from the blue filter portion (B) to the green filter portion (G), the black line BL2 necessarily enter the optical path; therefore, by adjusting the width of the black lines BL2 in the circumferential direction, the transmission of the spot light at the time of driving the micro-mirrors can be effectively prevented only by the rotation of the color filter-cum-shutter 5 at a constant speed.

While the black line BL2 stands in the optical path, the micro-mirrors corresponding to the green component of the image is moved to the effective position, and further, by rotating the color filter-cum-shutter 5, light is transmitted through the green filter portion (G), to carry out the exposure for the green component. Successively, the procedure enters into the preparation for it, that the digital micro-mirror device 3 is driven to let the micro-mirrors corresponding to the red component of the image move to the effective position.

In the same way, when the color filter-cum-shutter 5 is rotated in order to change over the transmitting portions from the green filter portion (G) to the red filter portion (R), the black line BL2 necessarily enter the optical path.

While the black line BL2 stands in the optical path, the micro-mirrors corresponding to the red component of the image is moved to the effective position, and further, by rotating the color filter-cum-shutter 5, light is transmitted through the red filter portion (R), to carry out the exposure for the red component. Successively, the procedure enters into the preparation for it, that the digital micro-mirror device 3 is driven to let the micro-mirrors corresponding to the blue component of the image move to the effective position. After this, by repeating the above-described operations, an image for one frame is to be formed.

In this connection, in the case where a color filter and a shutter are separately provided, it can be thought of that the shutter is made such one of the type of back-and-forth moving action as is used, for example, in a silver halide photographic camera; however, because the action speed of the order of 1/1000 sec is required, it can be said that a rotary shutter rotating at a constant speed as used in this embodiment is desirable in consideration for the reliability of the mechanism and the problem of vibration.

Figure 19:
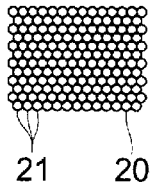
FIG. 19(*a*), FIG. 19(*b*), and FIG. 19(*c*) are drawings showing the optical fibers composing the light transfer means according to the seventh embodiment.
Figure 19:
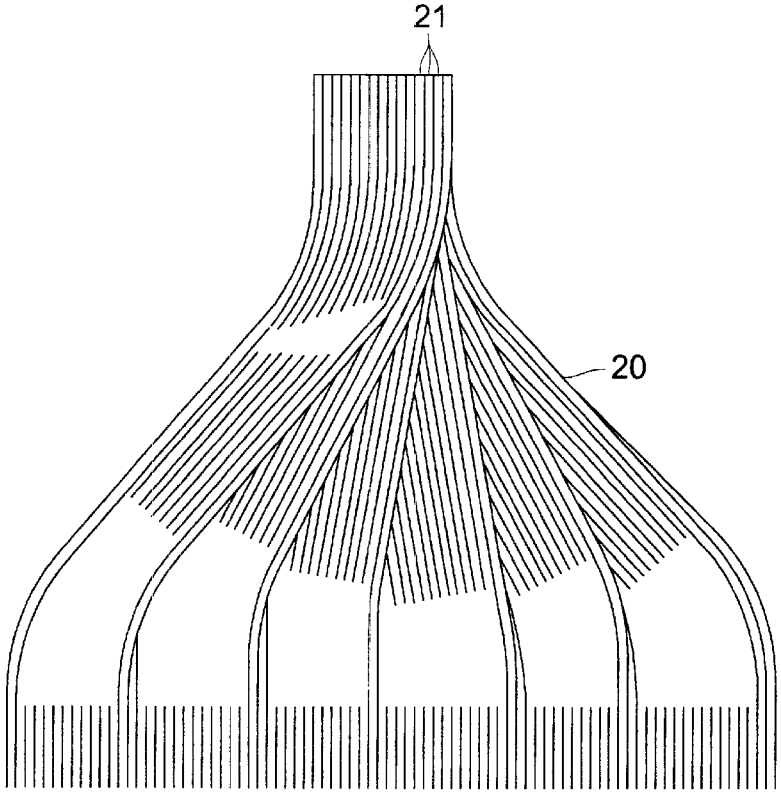
Figure 19:
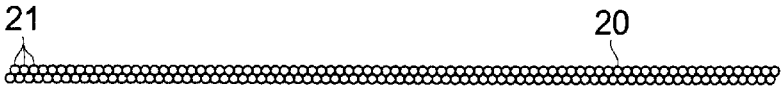
Figure 20:
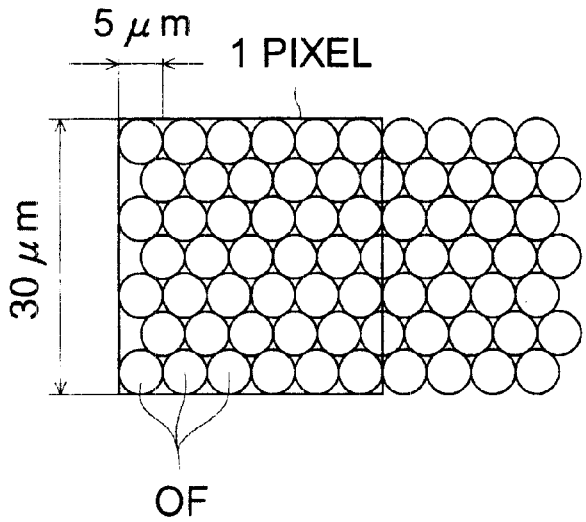
FIG. 20 is a drawing showing the relation between one pixel and optical fibers.

FIG. 19(*a*), FIG. 19(*b*) and FIG. 19(*c*) are drawings showing the optical fibers composing the light transfer means according to the seventh embodiment; FIG. 19(*a*) is the upper surface view, FIG. 19(*b*) is the front view, and FIG. 19(*c*) is the lower surface view. FIG. 20 is a drawing showing the relation between one pixel and optical fibers. As shown by the dotted line in FIG. 1, the optical fibers 20, shown in FIG. 19(*a*), FIG. 19(*b*) and FIG. 19(*c*), can be used instead of the mirror 7 in the first embodiment, and the other parts of the structure common to both will not be explained for the purpose of avoiding repetition. In addition, the digital micro-mirror device 3 and the optical fibers 20 compose the digital exposure means.

In FIG. 19(*a*), FIG. 19(*b*) and FIG. 19(*c*), the optical fibers 20 as light transfer means are composed of a number of the tubes 21, and inside each of the tubes 21, a large number of optical fiber cables OF (FIG. 20) are bound into a bundle. The optical fibers 20 have the upper end side (FIG. 19(*a*)) facing toward the digital micro-mirror 3 (FIG. 1) and the lower end side (FIG. 19(*c*)) facing toward the surface of the recording material 8. At the upper end side, the assembly of the optical fibers 20 is made to have a shape similar to that of the digital micro-mirror device 3, and at the other end side, it is made to have a shape of a line in the direction perpendicular to the moving direction of the recording material 8. That is, the optical fibers 20 is subjected to the re-arrangement or the movement of position in order that the two-dimensional digital imaging light received at the upper end may have its number of pixels increased in one direction at the lower end. In addition, it is possible to dispose a SELFOC lens between the optical fibers 20 and the recording material 8.

According to this embodiment, because the spot lights from the digital micro-mirror device 3 are transmitted by each of the optical fibers OF, an image having a broad width can be formed without enlarging the pixel size. Further, if the other end of the optical fibers 20 is made to have a shape of a line, the number of pixels in the moving direction of the recording material 8 is reduced, but it makes no particular problem, because an image having an arbitrary size can be formed by moving the recording material 8.

Further, by the projector lens 4 provided between the digital micro-mirror device 3 and the optical fibers 20 forming the image of the digital imaging light on the upper end of the optical fibers 20, by using the digital imaging light emerging from the other end for irradiation, an image having a higher image quality can be formed.

As clearly understood from FIG. 19(*a*) or FIG. 19(*b*), the layer stacking of the tubes 21 of the optical fibers 20 is made in a manner such that the tubes in the second row are arrayed with a deviation of a half pitch with respect to the tubes in the first row in the direction of the array, to make a state of higher density, and owing to it, when the digital imaging light is applied to the optical fibers 20, the effective transmittance by them can be improved.

As shown in FIG. 20, assuming that a pixel has a size of 30 $\mu$m square, the outer diameter of the optical fiber OF becomes 5 $\mu$m, and about 40 optical fiber cables can transmit the light for one pixel. Accordingly, even if breaking or the like is produced in any one of the optical fiber cables, the amount of exposure is not reduced to a large degree, and an image having a high image quality can be maintained even in such a case.

Incidentally, as shown in FIG. 19, when the re-arrangement or movement of position is carried out by varying the arrangement of the tubes 21 between the upper end and the lower end in order that the number of pixels of the two-dimensional digital imaging light may be increased in one direction, it occurs a problem that the tube 21 is rotated between the other end and the upper end. This problem can be solved with a software by studying the relation of correspondence between the incident pixel position of every spot light of the digital imaging light entering the optical fibers 20 and the emerging pixel position of the same spot light, but it takes a long time. According to the modified examples, this problem can be eased.

Figure 21:
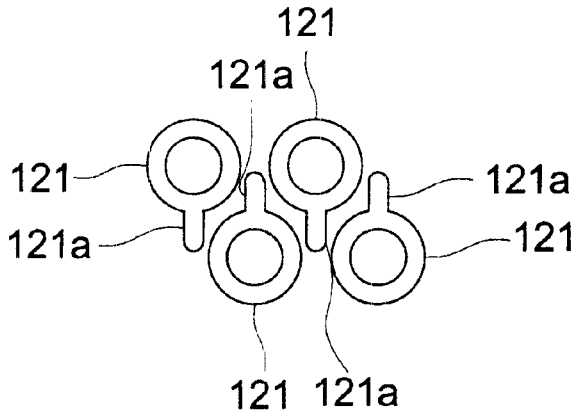
FIG. 21 is a drawing showing a modified example of the seventh embodiment.

FIG. 21 is a drawing showing a modified example of the seventh embodiment. Each of the tubes 121 have a projection 121*a* on the outer circumferential surface. In arranging the tubes 121, by putting each of the projections 121*a* between a pair of neighboring tubes, the orientation of these tubes is determined to be in a fixed direction. Owing to it, the transmission relation of light in the optical fibers is made simpler, and the adjustment of the digital printer for a recording material can be made easy. In addition, with respect to the shape of the tubes, instead of providing a projection 121*a*, it is also appropriate for the tubes to have a polygonal-shaped cross-section (221, 321) as shown in FIG. 22(*a*) and FIG. 22(*b*) so as to prevent the rotation when they are arrayed in a line.

Figure 23:
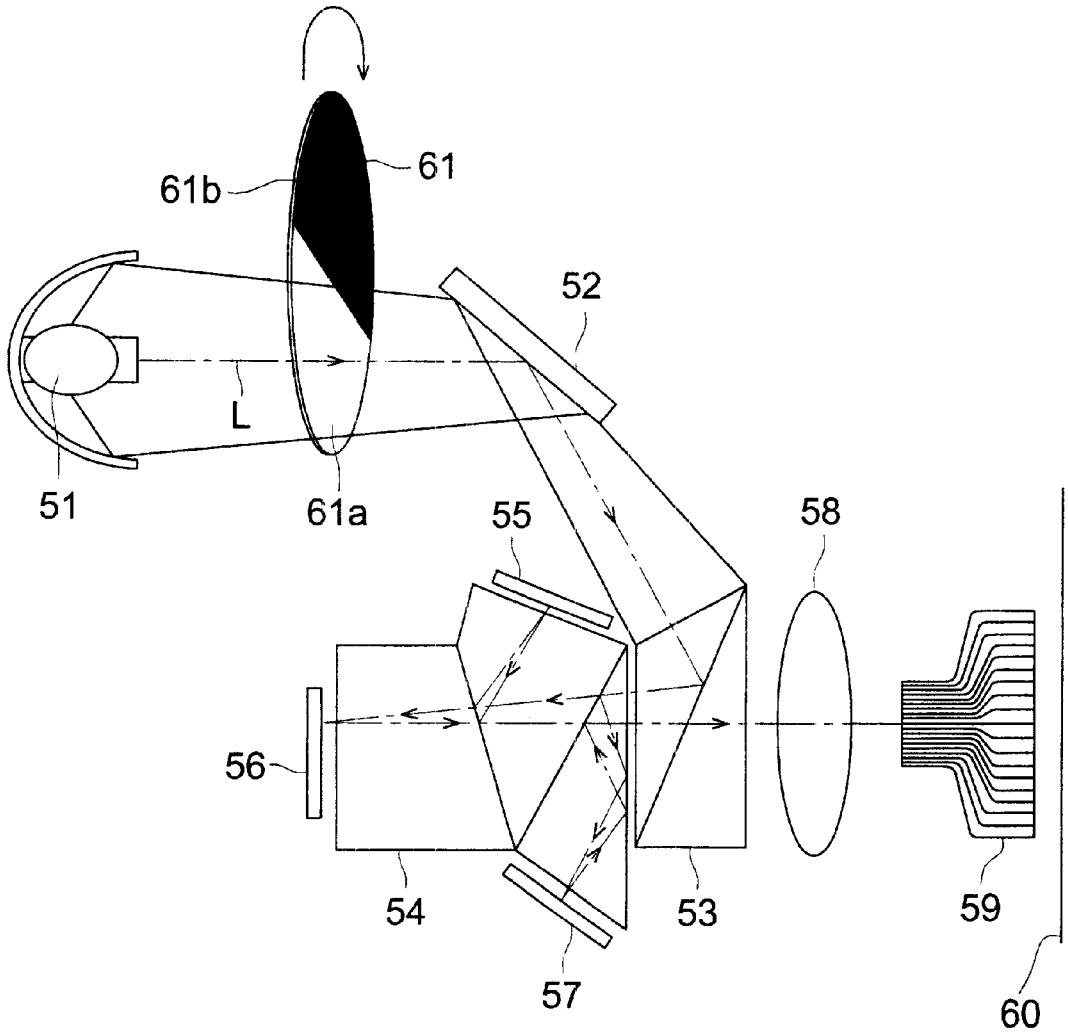
FIG. 23 is a drawing showing the outline of a digital printer for a recording material according to the eighth embodiment.

FIG. 23 is a drawing showing the outline of a digital printer for a recording material according to the eighth embodiment. In the eighth embodiment, a digital micro-mirror device is used for every color. To state it more concretely, the irradiation light L from the light source 51 is transmitted through the transmitting portion 61*a* of the circular plate 61 as a rotary shutter means, is reflected by the mirror 52, and enters the color separating-combining prism 54 through the TIR (total reflection) prism 54. In the color separating-combining prism 54, the irradiation light L is separated into the color components (red, green, and blue), which are reflected by the digital micro-mirror devices 55, 56, and 57 respectively.

At this time, only the necessary micro-mirrors of the digital micro-mirror devices 55, 56, and 57 are brought into the effective reflection state, and by making a design such that the reflected bundles of rays from these mirrors have a common optical axis, a desired color image is to be composed. These reflected bundles of rays are converged by the projector lens 58 onto the one end of the optical fibers 59 to form the image, which is transmitted through the optical fibers 59, and is applied to the recording material 60 from the other end. According to this embodiment, it is not necessary to use a color filter, and the structure can be more simplified; and on top of it, it is possible to make efficient the processing of formation of an image on the recording material.

The circular plate shutter 61 operates in a manner such that it rotates in synchronism with the driving of the micro-mirrors of the digital micro-mirror devices 55, 56, and 57, it lets the transmitting portion 61*a* enter the optical path only during exposure, and during the driving of micro-mirrors, by letting the non-transmitting portion 61*b* enter the optical path, it suppresses the stray light produced at the time of driving the micro-mirrors.

As has been explained in the foregoing, according to this invention, it is possible to provide a digital printer for a recording material capable of forming an image having a high image quality at a lower cost.

What is claimed is that:

1. A printer for recording an image on a recording material, comprising:

a light source to emit irradiation light;

a reflecting device to reflect said irradiation light, said reflecting device being integrated with a plurality of micro-reflectors, which are arrayed in two-dimensional directions of rows and lines, and each of which is independently controllable to vary a reflection angle of said irradiation light emitted from said light source;

a light guide to guide reflection light, reflected by said reflecting device, to a predetermined position on said recording material, said light guide having a two-dimensional light-receiving surface including a plurality of linear light guides, which are arranged in a vertical direction of said micro-reflectors so that each of them corresponds to each of said lines of said micro-reflectors, and a linear light-outputting surface at which said plurality of linear light guides are rearranged in a linear direction of said image so that a single scanning line of said image is irradiated onto said recording material corresponding to a two-dimensional image of said micro-reflectors; and a conveying device to convey said recording material in a predetermined direction;

wherein a light intensity at an end part of each linear light guide, being adjacent to a next linear light guide, is reduced to a half of its normal light intensity so that transition points from one linear light guide to next linear light guide on said single scanning line of said image exhibit normal light intensities.

2. The printer of claim 1, further comprising:

an optical system to focus an image onto said recording material, said optical system being disposed at at-least one of said two-dimensional light-receiving surface and said linear light-outputting surface.

3. The printer of claim 1, wherein said light guide includes a plurality of optical fibers.

4. The printer of claim 1, wherein said light guide includes a plurality of optical tubes into each of which a plurality of optical fibers are bundled, and said two-dimensional light-receiving surface is integrated with said plurality of optical tubes, which are arrayed in two-dimensional directions of rows and lines in such a manner that central positions of said optical tubes are staggered each other between two adjacent horizontal lines constituting each of said linear light guides, and said linear light guides are rearranged in a linear direction of said image at said linear light-outputting surface in such a manner that an optical tube at an end part of each linear light guide overlaps with another optical tube at an end part of next linear light guide so that said central positions of said optical tubes are staggered each other all over said single scanning line of said image.

* * * * *